US005141822A

United States Patent [19]

Matsuo et al.

[11] Patent Number: 5,141,822

[45] Date of Patent: Aug. 25, 1992

[54] PRECOATED STEEL SHEET HAVING IMPROVED CORROSION RESISTANCE AND FORMABILITY

[75] Inventors: Sachio Matsuo; Toshiaki Shiota, both of Osaka; Maki Itoh, Hyogo; Hideo Kawaguchi, Chiba; Hiroki Hanabata, Ibaraki; Yukihiro Yoshikawa, Osaka; Takao Taka, Osaka; Kiyoyuki Fukui, Osaka, all of Japan

[73] Assignee: Sumitomo Metal Industries Co., Ltd., Osaka, Japan

[21] Appl. No.: 620,449

[22] Filed: Dec. 3, 1990

Related U.S. Application Data

[63] Continuation of Ser. No. 383,550, Jul. 24, 1989, abandoned, which is a continuation-in-part of Ser. No. 123,567, Nov. 20, 1987, abandoned.

[30] Foreign Application Priority Data

Sep. 24, 1987 [JP] Japan ..... 62-239669

[51] Int. Cl.[5] ..... B32B 15/04

[52] U.S. Cl. ..... 428/623; 428/626; 428/659

[58] Field of Search ..... 428/621, 623, 624, 626, 428/632, 659

[56] References Cited

U.S. PATENT DOCUMENTS 4,411,964 10/1983 Hara et al. ..... 428/626
4,659,394 4/1987 Hara et al. ..... 428/626
4,775,600 10/1988 Adaniya et al. ..... 428/659

FOREIGN PATENT DOCUMENTS 23766 2/1986 Japan ..... 428/623
239941 10/1986 Japan ..... 428/623

*Primary Examiner*—George Wyszomierski
*Attorney, Agent, or Firm*—Burns, Doane, Swecker & Mathis

[57] ABSTRACT

A precoated steel sheet having improved corrosion resistance and formability is disclosed, which comprises a Zn- or Zn alloy-plated steel sheet having on the plated surface either a colloidal silica-containing chromate undercoat layer and a polyhydroxypolyether resin-based topcoat of 0.3 to 10 μm in thickness in which resin is derived by polycondensation of a dihydric phenol component selected from a mononuclear dihydric phenol, dinuclear dihydric phenol, and a mixture of both, with an epihalohydrin or a non-colloidal material-containing chromate underlayer and an epoxy resin based topcoat containing colloidal silica of a thickness of from 0.3–1.6 μm in thickness. In spite of the absence of zinc powder, the precoated steel sheet can be satisfactorily welded by resistance welding when the thickness of the topcoat layer is not greater than 2.5 μm, and even with such a thin topcoat, the precoated steel sheet retains its improved corrosion resistance and formability. The precoated steel sheet can be satisfactorily finish-coated by electrodeposition. The undercoat layer is produced by a two stage reduction of $Cr^{+6}$ to $Cr^{+3}$ in an aqueous suspension containing chromic acid.

17 Claims, 1 Drawing Sheet

Sound Spot

Irregular Spot

PRECOATED STEEL SHEET HAVING IMPROVED CORROSION RESISTANCE AND FORMABILITY

CROSS REFERENCE TO RELATED APPLICATIONS

This application is a continuation of application Ser. No. 07/383,550, filed Jul. 24, 1989, which is a continuation-in-part of application Ser. No. 123,567, filed Nov. 20, 1987, both now abandoned.

BACKGROUND OF THE INVENTION

1. Field of the Invention

This invention relates to a precoated corrosion-resistant steel sheet having a chromate undercoat and an organic topcoat. More particularly, it relates to such a duplex coated steel sheet which possesses good corrosion resistance and formability, can be finish coated by electrodeposition, and is preferably weldable by means of resistance welding so that it is highly suitable for use in automobile bodies.

2. Description of the Prior Art

Weldable precoated steel sheets which can be welded by electrical resistance welding have been increasingly used in automobile bodies in order to prevent them from rusting due to salt which is spread on roads for melting snow in snowy areas.

Typical weldable precoated steel sheets are Zincrometal (a registered trademark of Diamond Shamrock) and similar precoated steel sheets having a coating of a zinc-rich primer. Zincrometal comprises a steel sheet having an undercoat of a zinc-chromate solution (Dacromet, a registered trademark of Diamond Shamrock), and a topcoat of a zinc-rich epoxy resin-based primer (Zincromet, a registered trademark of Diamond Shamrock) and exhibits a significantly higher corrosion resistance than cold rolled steel sheets. Similar weldable precoated steel sheets called "Z-coat steel sheets" have an undercoat made by phosphate treatment and a topcoat of a zinc-rich primer such as Zincromet.

It is known that various additives may be incorporated in the zinc-chromate undercoat of Zincrometal. Such additives include reducing agents, metal chromates, oxides and hydroxides of an amphoteric metal, and hydrophilic colloids. See Japanese Patent Publications Nos. 47-6882(1972), 52-904(1977), and 52-4286(1977), and Japanese Patent Laid-Open Applications Nos. 49-74137(1974), 49-74138(1974), and 49-74139(1974).

In general, precoated steel sheets for use in automobile bodies or the like are required to have good formability, weldability, and corrosion resistance. In this connection, however, the properties, particularly the formability and corrosion resistance of the above-mentioned Zincrometal and Z-coat steel sheets are not satisfactory. This is because the zinc-rich primer used to form the topcoat of these precoated steel sheets contains a large amount of zinc powder or dust (hereinafter referred to as zinc powder) equal to around 50% on a volume basis or approximately 85% to 90% on a weight basis so that the topcoat films are brittle and tend to be readily peeled off during working or forming such as press forming. Such peeling or removal of the topcoat results in a significant loss of corrosion resistance of the precoated steel sheet. In addition, the removed pieces of the topcoat readily adhere to the die of the press machine, which may cause formation of flaws or scratches on the coated surfaces of precoated steel sheets being formed on the machine thereafter. Therefore, the die must be cleaned more frequently and the working efficiency is significantly decreased.

Another disadvantage of a zinc-rich primer is that the dry film thereof has a relatively large water permeability, which is also responsible for the propensity of its corrosion resistance to decrease. These problems, i.e., peeling of the coated film deterioration in corrosion resistance can be effectively alleviated by decreasing the content of zinc powder in the epoxy resin-based primer. However, this results in an increase in electrical resistance of the film, which makes it difficult or impossible to apply resistance welding to the precoated steel sheet.

In the above-mentioned precoated steel sheets, it is necessary to cure the topcoat of a zinc-rich primer by baking at a high temperature in the range of from 250° to 280° C., resulting in a loss of bake-hardenability of the base steel sheet if the base steel is of the bake-hardening type. The term "bake-hardening" used herein indicates that the yield stress of the steel is increased during baking of a finish coated applied, for example, by electrodeposition after press forming.

As another type of corrosion-resistant steel sheet, Japanese Patent Laid-Open Application No. 57-108292(1982) discloses a precoated steel sheet comprising a plated steel sheet with a Zn- or Al-based plating, the steel sheet having a chromate film formed on the plated surface and an organic composite coating formed on the chromate film. The organic composite coating comprises an organic water-soluble or water-dispersible resin such as an acrylic copolymer, epoxy resin, polyvinyl alcohol or starch and a silica sol (hydrophilic colloidal silica). The precoated steel sheet has improved corrosion resistance before and after finish coating and provides the finish coating with good adhesion.

It is also known that silica sol or colloidal silica may be incorporated into a chromate solution in order to improve the corrosion resistance of the chromated steel sheet and to increase the adhesion to a finish coating formed thereon. See, for example, Japanese Patent Publication No. 42-14050(1967).

It has been proposed to use a chromate solution in which a part of the hexavalent chromic acid has been reduced to trivalent chromium in order to decrease the solubility of the resulting chromate film, thereby improving the corrosion resistance of the steel sheet (Japanese Patent Publication No. 52-2851(1977)).

Japanese Patent Laid-Open Application No. 54-161549(1979) discloses a chromate solution which comprises partially reduced chromic acid and silica sol. A galvanized steel sheet treated with this solution has improved corrosion resistance due to the presence of $Cr^{3+}$ and silica sol in the chromate film.

Japanese Patent Laid-Open Application No. 60-86281(1985) discloses a highly corrosion-resistant precoated steel sheet comprising a plated steel sheet having thereon a chromate undercoat layer and a topcoat layer of, e.g., a zinc-rich primer in which the chromate undercoat is formed from an aqueous suspension containing chromic acid, an iron phosphide powder, and optionally one or more substances selected from a dicarboxylic acid or a diol, zinc chromate or strontium chromate, oxides or hydroxides of zinc or strontium, and phosphoric acid.

Japanese Patent Laid-Open Application No. 61-239941(1986) discloses a weldable precoated steel sheet comprising a steel sheet plated with zinc or zinc base alloy, the steel sheet having a chromate film on the plated surface which is formed from an aqueous suspension containing chromic acid, an iron phosphide powder, and optionally a metal chromate, and a topcoat layer on the chromate film which is based on a polyhydroxypolyether resin formed by polycondensation of a mononuclear dihydric phenol or a mixture of a mononuclear dihydric phenol and a dinuclear dihydric phenol with an epihalohydrin.

SUMMARY OF THE INVENTION

It is an object of the present invention to provide a precoated steel sheet having an organic topcoat layer which is substantially free from zinc powder and which exhibits improved corrosion resistance and formability and good adhesion to a finish coating formed on the topcoat, for example, by electrodeposition coating.

Another object of the invention is to provide a precoated steel sheet which is weldable by electrical resistance welding and which is free from the above-mentioned disadvantages of the prior-art weldable precoated steel such as Zincrometal and Z-coat steel sheets having a coating of a zinc-rich primer.

A further object of the invention is to provide a precoated steel sheet having a chromate undercoat layer and an organic topcoat layer in which the topcoat can be baked at a relatively low temperature so as not to interfere with the bake-hardenability of the base steel.

According to one aspect of the present invention, there is provided a precoated steel sheet having improved corrosion resistance and formability, which comprises a Zn- or Zn alloy-plated steel sheet having on the plated surface an undercoat of a chromate film with a weight of 10–600 mg/m$^2$ as Cr and a topcoat of 0.3–10 μm in thickness, wherein the undercoat is formed from an aqueous suspension containing partially-reduced chromic acid, colloidal silica and at least one reducing agent selected from the group consisting of a polyhydric alcohol, a polycarboxylic acid, and a hydroxycarboxylic acid, in amounts such that the weight ratio of silica to total chromic acid is in the range of from 0.1:1 to 5:1, said partially-reduced chromic acid has a ratio of $Cr^{3-}/(Cr^{3-}+Cr^{6+})$ in the range of from 0.1 to 0.6, and the molar ratio of reducing agent to unreduced chromic acid is in the range of from 0.01:1 to 2.0:1 and the topcoat is formed from a coating composition containing as a base resin a polyhydroxypolyether resin prepared by polycondensation of a dihydric phenol component selected from a mononuclear dihydric phenol, dinuclear dihydric phenol, and a mixture of both with an epihalohydrin, said topcoat being baked at a temperature of from 80° to 200° C., and both of said undercoat and topcoat layers being free of substantial amount of zinc powder.

In a preferred embodiment of this aspect of the invention, the aqueous suspension used to form the undercoat layer may contain, in addition to partially-reduced chromic acid, colloidal silica and one or more reducing agents selected from the group consisting of a polyhydric alcohol, a polycarboxylic acid and a hydroxycarboxylic acid, an iron phosphide powder, and a metal chromate or its precursor, and the coating composition used to form the topcoat layer may further contain at least one additive selected from an inorganic filler and a cross-linking agent. Also a plasticizer such as an acrylate or methacrylate ester or a flexible resin such as butyral resin, or a mixture of these may be incorporated in the topcoating composition.

According to another aspect of the present invention, there is provided a precoated steel sheet having improved corrosion resistance and weldability, which comprises a Zn or Zn alloy-plated steel sheet having on the plated surface an undercoat of a chromate film with a weight of 20–100 mg/m$^2$ as Cr and a topcoat of 0.3–1.6 μm in thickness, wherein said undercoat is formed by applying or firing after application a chromate solution, the chromate solution is an aqueous suspension which contains chromic acid partially reduced to give a ratio of $Cr^{3+}/(Cr^{3+}+Cr^{+6})$ of 0.4–0.6 and a reducing agent in an amount of 1–4 times larger than that required to reduce the remaining $Cr^{+6}$ to $Cr^{3+}$, the aqueous solution is substantially free from colloidal materials, and said topcoat is formed by applying or firing after application a resin-containing solution which contains as a base resin an epoxy resin together with colloidal silica in amounts of 10–25% by weight based on the total amount of resin solids and colloidal silica in the resin-containing solution.

DESCRIPTION OF THE PREFERRED EMBODIMENTS

Base Material

Figure 1:
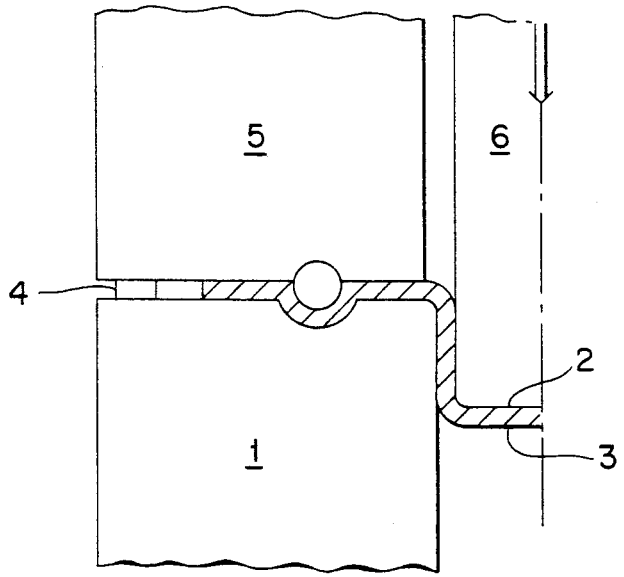
FIG. 1 is a schematic cross-sectional view showing a test piece undergoing a U-bend press forming test.

The base material of the precoated steel sheet of the present invention is a steel sheet plated with zinc or a zinc-based alloy. The zinc or zinc alloy plating may be carried out by hot dipping, electroplating, or electroless plating. The plating weight is preferably in the range of 5–100 g/m$^2$, and more preferably in the range of 10–60 g/m$^2$.

Examples of a zinc alloy useful for plating of the steel sheet include Zn-Ni, Zn-Fe, and Zn-Al. Alloyed galvanized steel sheet which is prepared by heating a galvanized steel sheet sufficiently to form an Ni-Fe alloy in the plating layer is also included in the zinc alloy-plated steel sheet. The base material may be of the duplex plating type having two or more plating layers on the substrate steel sheet as long as the uppermost layer is a Zn or Zn alloy plating. In such cases, the underlying plating layers may be comprised of other metals or alloys.

The zinc- and zinc alloy-plated steel sheets as the base material may be hereinafter collectively referred to as galvanized steel sheets.

Undercoat Chromate Layer

The following description is of the undercoat chromate layer for the embodiment of the first aspect of the present invention which contains colloidal silica.

In general, a chromate film is formed from an aqueous chromic acid solution by reduction of chromic acid and evaporation of water during baking of the applied wet coating.

According to the present invention, an aqueous suspension which contains partially-reduced chromic acid and colloidal silica is used to form the undercoat chromate layer in order to promote reduction of chromic acid and film formation so as to enable a chromate film to be efficiently formed at a lower temperature.

The use of partially-reduced chromic acid decreases the amount of chromic acid which has to be reduced during baking of the applied wet coating, and accelerates film formation. The ratio of partial reduction of chromic acid as defined by $Cr^{3+}/(Cr^{3+}+Cr^{6+})$ in the chromating solution is preferably in the range of 0.1–0.6 and more preferably in the range of 0.3–0.6. If this ratio is less than 0.1, it is difficult to efficiently carry out the reduction of chromic acid in the wet chromate coating during baking. On the other hand, if the ratio is greater than 0.6, it is difficult to maintain the chromium ions as a stable solution due to the instability of $Cr^{3+}$ in solution.

Partial reduction of chromic acid may be carried out by reacting an aqueous chromic acid solution with a suitable reducing agent such as those described below at an elevated temperature prior to addition of colloidal silica and other optional additives.

Colloidal silica serves to increase the wetting power of the chromic acid solution, thereby accelerating the film formation of the chromate wet coating, and for this purpose it is added to the partially-reduced chromic acid solution in an amount such that the weight ratio of silica to total chromic acid is in the range of from 0.1:1 to 5:1. The term "total chromic acid" means the total weight as $CrO_3$ of $Cr^{3+}$ and $Cr^{6+}$ ions present in the aqueous medium. If the above weight ratio is less than 0.1:1, the effect of colloidal silica on acceleration of film formation is inadequate. If the ratio is greater than 5:1, the resulting chromate film becomes brittle due to the presence of too much silica.

The colloidal silica which is present in the undercoat chromate layer may be either of the dry type or wet type. Typical colloidal silica of the dry type is commercially available under the registered trademark "Aerosil". Wet-type colloidal silica is commercially available in the form of a stable aqueous suspension, for example, sold under the trade names Ludox (du Pont), Nalcoag (Nalco Chemical), Syton (Monsanto), Snowtex (Nissan Kagaku), and Cataloid (Shokubai Kasei).

The average particle diameter of the colloidal silica is not critical, and it is preferably within the range of 1–100 nm.

The following additives (a)–(e) may be optionally added to the aqueous suspension used in the present invention to form the undercoat chromate film.

(a) Silane coupling agent:

A silane coupling agent serves to strengthen the colloidal silica-containing chromate film by hydrolysis to form a polysiloxane, thereby improving the adhesion between silica particles and the chromate film matrix and between the topcoat and the undercoat layers. It is also advantageous in that hydrolysis of the silane coupling agent results in the formation of an alcohol, which acts as a reducing agent for chromic acid.

Examples of useful silane coupling agents include vinyltriethoxysilane, vinyl-tris(beta-methoxyethoxy)silane, gamma-methacryloxypropyltrimethoxysilane, gamma-glycidoxypropyltrimethoxysilane, gamma-aminopropyltriethoxysilane, N-beta-(aminoethyl)-gamma-aminopropyltrimethoxysilane, beta-(3,4-epoxycyclohexyl)ethyltrimethoxysilane, and the like.

When a silane coupling agent is added to the aqueous suspension, it is preferably used in an amount such that the molar ratio of silane to unreduced chromic acid is at least 0.01, i.e., in an amount of at least 1 mole % based on the unreduced chromic acid remaining in the suspension. If the amount of a silane coupling agent is less than 1 mole % of the unreduced chromic acid, the above-mentioned advantages of the silane coupling agent will not be attained sufficiently. Addition of a silane coupling agent in an excessively large amount will be disadvantageous from an economical viewpoint.

(b) Polyhydric alcohol, polycarboxylic acid, hydroxycarboxylic acid (reducing agent):

One or more compounds selected from polyhydric alcohols, polycarboxylic acids, and hydroxycarboxylic acids may be added in the aqueous suspension as an reducing agent in order to enhance the efficiency of reduction of chromic acid at a relatively low baking temperature.

Examples of polyhydric alcohols useful in the present invention include ethylene glycol, propylene glycol, and glycerol. Examples of useful polycarboxylic acids include succinic acid, glutaric acid, and adipic acid. Examples of useful hydroxycarboxylic acids are citric acid and lactic acid.

Part of the above reducing agents may be replaced by a sugar.

These reducing agents are preferably added in an amount such that the molar ratio of total reducing agents to unreduced chromic acid is in the range of from 0.01:1 to 2.0:1. If the molar ratio is less than 0.01:1, the efficiency of reduction of chromic acid will not be enhanced adequately. If the reducing agent is added in a molar amount greater than twice the molar amount of unreduced chromic acid, further enhancement of reduction efficiency will not be obtained and moreover the reducing agent will be retained in the chromate film after baking, thereby deteriorating the water resistance of the film.

(c) Iron phosphide powder:

When an iron phosphide in the form of fine powder is present in an aqueous chromate solution, it reacts with free hexavalent chromium ions in the wet chromate coating during baking, thereby decreasing the amount of these ions in the chromate film. The hexavalent chromium ions are soluble in water which penetrates into the chromate film through the finish coating and topcoat layers formed thereon. A decrease in the amount of these ions in the chromate film is therefore effective in maintaining the corrosion resistance and adhesion of the chromate film in a corrosive environment.

Since an iron phosphide is electrically conductive, the incorporation of an iron phosphide powder facilitates electrodeposition performed on the precoated steel sheet to form a finish coating, and resistance welding of the precoated steel sheet is also facilitated in spite of the absence of zinc powder, making the welding operation more efficiently. Therefore, it is desirable to add an iron phosphide powder to the aqueous chromate suspension, particularly in the case of a precoated steel sheet having a relatively thick topcoat organic layer on which electrodeposition coating and/or resistance welding is to be performed.

An iron phosphide powder is water-insoluble and when it is present in an aqueous chromic acid solution it forms a suspension. Therefore, in order to allow it to efficiently react with free hexavalent chromium ions, it is preferable to add it in an amount of at least 10% by weight based on the total chromic acid. On the other hand, addition of an excessively large amount of an iron phosphide powder results in loss of adhesion of the iron phosphide particles to the chromate film, which may readily cause peeling of the coating during working or forming, thereby deteriorating formability and corrosion resistance. Due to the above-mentioned conductive nature, addition of an excessively large amount of an iron phosphide powder is also disadvantageous in that an electric current can readily pass between the base steel sheet and the surface of the coating, resulting in a significant reduction of the ability of the coating to function as a corrosion barrier. These phenomena are prominent when the weight ratio of iron phosphide to total chromic acid exceeds 20:1. Accordingly, when an iron phosphide powder is added, it is preferably used in an amount such that the weight ratio of iron phosphide to total chromic acid is in the range of from 0.1:1 to 20:1, and more preferably is in the range of from 1:1 to 10:1.

In addition to the most common iron phosphide in the form of $Fe_2P$ [ferrous (II) phosphide], several other compositions of iron phosphide are known, such as FeP, $Fe_3P$, and $FeP_2$. All of these iron phosphides may be used in the present invention singly or in combination. It is preferable to use an iron phosphide in the form of a fine powder having an average particle diameter of not greater than 5 μm.

(d) Metal chromate:

The aqueous suspension which contains partially reduced chromic acid and colloidal silica may further contain a metal chromate. A metal chromate, when incorporated in the chromate film, serves as a rust-preventive pigment, increasing the rust-preventing properties of the film. More specifically, a metal chromate can passivate iron and zinc metals in the base galvanized steel sheet and suppress dissolution of these metals in a corrosive environment, thereby contributing to further improvement in corrosion resistance of the precoated steel sheet. Therefore, it is preferred to incorporate a metal chromate in the undercoat chromate film.

Examples of a metal chromate useful for this purpose are zinc chromate and strontium chromate. A precursor of a metal chromate can also be used. Such a precursor includes metal oxides and hydroxides such as zinc oxide and hydroxide and strontium oxide and hydroxide. In an aqueous medium containing chromic acid, these metal oxides or hydroxides react with chromate ions to form a metal chromate.

Addition of an excessive amount of a metal chromate inhibits film formation of a chromating solution and decreases the adhesion of the resulting chromate film to the base steel sheet. Accordingly, when a metal chromate is added, it is preferably used in a molar amount less than or equal to the amount of residual unreduced chromic acid present in the aqueous suspension. When a precursor of a metal chromate in the form of an oxide or hydroxide is used, it is preferable to add the precursor in an amount of at most 50 mole % based on the unreduced chromic acid, since the precursor reacts with chromic acid and consumes it as described above.

When a metal chromate is added to the aqueous suspension, the Cr values originating from such chromate are excluded from the total chromic acid referred to in the above.

(e) Other optional additive:

In order to further improve the adhesion between the chromate film and the galvanized base steel sheet, the aqueous suspension comprising partially-reduced chromic acid and colloidal silica may further contain phosphoric acid in a molar amount less than or equal to the molar amount of the unreduced chromic acid present in the aqueous suspension.

The above-mentioned aqueous suspension is applied to a galvanized steel sheet so as to give a chromate film having a weight of at least 10 $mg/m^2$ as Cr on the plated surface. Preferably, the weight of the chromate film is in the range of 10–600 $mg/m^2$ as Cr, more preferably 30–300 $mg/m^2$ as Cr, and most preferably 30–100 $mg/m^2$ as Cr.

The Cr weight referred to herein means the weight of Cr coming from the partially reduced chromic acid component in the suspension, and it does not take account of the Cr values coming from the metal chromate component (d) when it is added.

If the chromate film has a weight of less than 10 $mg/m^2$ as Cr, the precoated steel sheet will not have satisfactory corrosion resistance. A chromate film having a weight far beyond 100 $mg/m^2$ as Cr may sometimes cause increased damage to tip electrodes during spot welding of the precoated steel sheet. In a precoated steel sheet having a thick chromate film with a weight exceeding 600 $mg/m^2$ as Cr, peeling of the coating may readily occur during severe working such as press forming or deep drawing. However, when severe working or forming is not applied to the precoated steel sheet, as in the case of precoated steel sheets for use as building materials, such a thick chromate film with a weight exceeding 600 $mg/m^2$ as Cr may be applied as the undercoat layer.

The aqueous suspension which contains partially reduced chromic acid, colloidal silica, and optionally other additives may be applied by any conventional coating means, for example, by use of a wire-wound rod coater, roll coater, or spray coater, or by dipping.

As is apparent to those skilled in the art, the galvanized steel sheet having a wet chromate coating applied on the plated surface as above is then baked to form an insoluble chromate film in the conventional manner. The baking is preferably carried out at a temperature of 60°–200° C., and more preferably 100°–150° C. for a time sufficient to obtain a dry film.

In regard to the second embodiment of the present invention (in which there is no colloidal silica or other colloids in the undercoat) the basic principles in regard to the formation of the undercoat chromate layer as set forth above are also applicable with the exceptions noted hereafter.

First, the aqueous solution is substantially free from any collodial material including colloidal silica. In addition, the undercoat is applied to a film weight of 20–100 $mg/m^2$ as Cr by applying or firing after application a chromate solution which contains chromic acid partially reduced to give a ratio of $Cr^{3+}/(Cr^{3}+Cr^{+6})$ of 0.4–0.6 and a reducing agent in the amount of 1 to 4 times larger than that required to reduce the remaining $Cr^{+6}$ to $Cr^{3+}$. Preferably, the chromate solution further includes a silane coupling agent of the same type as discussed above in regard to the first aspect of the first aspect of the present invention in an amount such that the molar ratio of silane coupling agent to unreduced chromic acid ($Cr^{+6}$) is at least 0.01:1.

Organic Topcoat Layer

The following description is of the organic topcoat layer for the embodiment of the first aspect of the present invention. This organic topcoat layer is based on a polyhydroxypolyether resin applied on the undercoat colloidal silica-containing chromate film. The topcoating composition may contain, in addition to the above base resin, an inorganic filler, a cross-linking agent, and/or a monomeric or polymeric plasticizer. Additional resins other than the polyhydroxypolyether resin may be added in a total amount of less than 50% by weight of the resin solids in the topcoating composition.

The polyhydroxypolyether resin which is used as a base resin of the topcoat in accordance with the invention is prepared by polycondensation of a dihydric phenol and an epihalohydrin in the presence of an alkaline catalyst. The dihydric phenol may be either a mononuclear one having one benzene nucleus, e.g., resorcinol, hydroquinone, or catechol, or a dinuclear one having two benzene nuclei, e.g., bisphenol A (2,2-bis(4'-hydroxyphenyl)propane), bisphenol F (bis(4'-dydroxyphenyl)methanel), or a mixture of a mononuclear and a dinuclear phenols. The epihaloydrin includes epichlorohydrin, epibromohydin, and epibromohydrin, and epiiodohydrin.

Epichlorohydrin is preferred. A diepoxide compound may be used in place of an epihalohydrin.

A polyhydroxypolyether resin in which the dihydric phenol component is comprised of an equimolar mixture of resorcinol (mononucelar) and bisphenol A (dinuclear) is characterized by recurring units of the following formula:

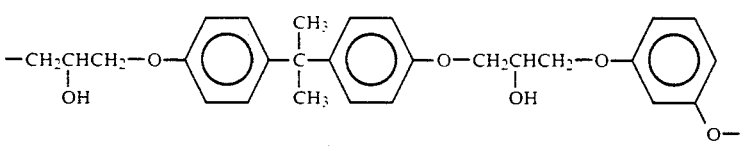

(I)

A polyhydroxypolyether resin in which the dihydric phenol component is comprised solely of resorcinol is characterized by recurring units of the following formula:

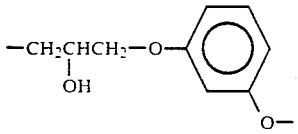

(II)

A high molecular-weight polyhydroxypolyether resin in which the dihydric phenol component is comprised solely of bisphenol A is also known as a phenoxy resin and sold by Union Carbide Corp. under the trade name "PKHH". PKHH is characterized by recurring units of the following formula:

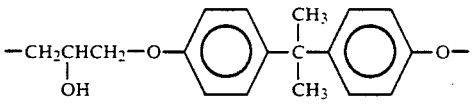

(III)

The polyhydroxypolyether resins, particularly high molecular-weight polyhydroxypolyether resin, and their preparation are described in Japanese Patent Laid-Open Application No. 57-102925 (1982).

Also included in the polyhydroxypolyether resin useful as the base resin of the topcoat layer are epoxy resins of the glycidyl ether type which are prepared by polycondensation of a mononuclear or dinuclear dihydric phenol or a mixture of both and an epihalohydrin. The epoxy resins of this type have the same recurring units as illustrated above although they have terminal epoxy groups at the ends of the polymer chain. Epoxy resins useful in the present invention include common epoxy resins derived from bisphenol A, bisphenol F, or a dinuclear brominated epoxide and an epihalohydrin. Modified epoxy resins such as epoxy esters, epoxy urethanes, and epoxy acrylates are also included in the epoxy resins. Epoxy esters are prepared by using a fatty acid derived from a drying oil and reacting epoxy and hyrdroxyl groups in an epoxy resin with carboxyl groups in the fatty acid. Epoxy urethanes can be prepared by reacting an epoxy resin with an isocyanate compound. Epoxy acrylates can be prepared by modifying an epoxy resin with acrylic acid, methacrylic acid, or a similar unsaturated carboxylic acid.

Particularly suitable for use as the base resin of the topcoat layer is a high molecular-weight polyhydroxypolyether resin having a number-average molecular weight of at least 5,000, and preferably in the range of 8,000–50,000. Such a high molecular-weight polyhydroxypolyether resin may be prepared by reacting a lower molecular-weight epoxy resin derived from a dihydric phenol component and an epihalohydrin, e.g., bisphenol A di- or poly-glycidyl ether, with an additional amount of a dihydric phenol.

In the case of using a common epoxy resin as a polyhydroxypolyether resin, the molecular weight of the base resin may be much lower. However, the molecular weight of the epoxy resin should preferably be at least 1000 so that a tack-free film can be readily obtained by baking at a relatively low temperature which is not sufficient to completely cure the epoxy resin. Of course, an epoxy resin having a higher molucular weight, for example, on the order of 5,000 or higher may be used.

As shown in the above structural formulas of recurring units, polyhydroxypolyether resins including epoxy resins have many —OH groups and —O— groups in the polymer chain. Hydroxyl groups (—OH) can form hydrogen bonding with the underlying chromate film and assure that the topcoat layer has improved adhesion to the chromate film, while oxy groups (—O—) allow easy rotation of the polymer chain and assure that the topcoat layer has enhanced flexibility.

Regarding the number of these functional groups in a given weight of a polymer, a polyhydroxypolyether resin derived from a mononuclear dihydric phenol such as resorcinol has a number greater than that derived from a dinuclear dihydric phenol such as bisphenol A, because the molecular weight of resorcinol is lower than that of bisphenol A. For example, when resorcinol and bisphenol A are used in molar ratios of 0/1, 1/1, and 1/0 in polycondensation with an equimolar amount of an epihalohydrin, the numbers of —OH and —O— functional groups present in each 100 molecular weight of the resulting polyhydroxypolyether resin are as follows:

| Molar ratio of resorcinol/ bisphenol A | Weight % resorcinol | Number of —OH groups | Number of —O— groups |
|---|---|---|---|
| 0/1 | 0 | 0.35 | 0.70 |
| 1/1 | 23 | 0.44 | 0.89 |
| 1/0 | 66 | 0.60 | 1.20 |

Thus, as the content of a mononulear phenol in the dihydric phenol component is increased, the resulting resin contains —OH and —O— functional groups at an increased concentration, and, as a general trend, a coating formed therefrom has an increased adhesion and flexibility. Therefore, in order to enhance the corrosion resistance and formability of the precoated steel sheet, it is generally advantageous to use a polyhydroxypolyether resin in which at least part of the dihydric phenol component is comprised of a mononuclear phenol such as resorcinol. However, even in the cases where the base resin is a polyhydroxypolyether resin in which a dinuclear phenol such as bisphenol A comprises 100% of the dihydric phenol component, the resin has many —OH and —O— groups as shown in the above Formula (III), and a precoated steel sheet having a topcoat of such a base resin still possesses satisfactory corrosion resistance and adhesion.

The topcoating composition may be prepared by dissolving one or more polyhydroxypolyether resins (including an epoxy resins and modified epoxy resins) in an organic solvent. The organic solvent may be selected depending on the properties required for the topcoat layer such as drying rate and film smoothness as well as the type and molecular weight of the polyhydroxypolyether resin. For dissolution of a high molecular-weight polyhydroxypolyether resin, solvents such as cellosolves, ketones, glycol-ethers, and mixtures of these can be used. When the base resin is a polyhydroxypolyether resin of lower molecular weight, for example, not greater than 10,000, any solvent commonly used in epoxy coating compositions, for example, cellosolves, ketones, esters, alcohols, hydrocarbons, halogenated hydrocarbons, and mixtures of these may be used.

The topcoating composition may further contain at least one additive selected from the following groups (A) to (C).

(A) Inorganic filler:

One or more inorganic fillers may be added to the topcoating composition in order to further improve the corrosion resistance of the precoated steel sheet.

Examples of inorganic fillers useful in the present invention include the above-mentioned metal chromates such as zinc chromate and strontium chromate, as well as other inorganic fillers such as calcium carbonate, alumina, various silicates, zinc phosphate, calcium phosphate, zinc phosphomolybdate, aluminum phosphomolybdate, silica powder, colloidal silica, and the like.

Any type of the colloidal silica described previously as an additive to the chromate undercoat layer may be used as an inorganic filler to be added to the organic topcoat layer. When colloidal silica is present as an inorganic filler in the organic topcoat layer, a silane coupling agent as mentioned previously may be added in a small amount to the topcoating composition in order to increase the adhesion between the silica particles and the resin matrix, thereby further improving corrosion resistance of the organic coating.

Metal chromates such as zinc chromate and strontium chromate serve as rust-preventive pigments as described above and are highly effective for improving the corrosion resistance of the coating when it is present in the organic topcoat layer. However, when the resulting precoated steel sheet is pretreated by degreasing or chemical conversion treatment prior to finish coating, some of the chromate ions present in the topcoat layer tend to dissolve in the aqueous solution used in the pretreatment, causing rapid contamination of the solution. Therefore, if the precoated steel sheet is subsequently treated with a degreasing solution or a chemical conversion solution, it is preferred that the amount of a metal chromate added to the topcoat layer be minimized.

The amount of inorganic filler added to the topcoating composition is at most 40% by volume, and preferably in the range of 1–20% by volume, based on the total resin solids in the coating composition. If it is less than 1% by volume, the improvement in corrosion resistance will not be significant. Addition of an inorganic filler in excess of 40% by volume may cause deterioration in the adhesion or corrosion resistance of the organic coating, and may increase the electrical resistance of the coating to such a degree that electrodeposition or resistance welding such as spot welding becomes difficult.

(B) Cross-linking agent:

One or more cross-linking agents may be added in order to further improve corrosion resistance of the precoated steel sheet. It is believed that cross-linking of the base resin can strengthen the coating, thereby improving the corrosion resistance thereof.

For this purpose, any cross-linking agent or curing agent which is known as effective in curing epoxy resins may be used. Examples of such cross-linking agents include a phenolic resin, an amino resin, a polyamide, an amine, an isocyanate including a blocked isocyanate, and an acid anhydride. Preferred cross-linking agents are blocked isocyanates.

When a cross-linking agent of the blocked type such as a blocked isocyanate is used, it is advantageous that the cross-linking agent does not release the functional groups, e.g., isocyanate groups in a blocked isocyanate, at the baking tempearture of the topcoat layer. In other words, it is preferred that the releasing temperature of the blocked-type cross-linking agent be higher than the baking temperature of the topcoat. In such a case, cross-linking of the base resin does not occur during baking of the topcoat layer, resulting in the formation of a topcoat layer which still fully retains the flexible nature of the base resin, and the formability of the precoated steel sheet obtained after baking is not deteriorated in spite of the presence of the cross-linking agent. After the precoated steel sheet is formed into a desired shape and then finish-coated, for example, by electrodeposition, the finish coating is baked. By selecting a baking temperature of the finish coating which is sufficiently high to activate the blocked-type cross-linking agent in the topcoat layer of the precoated steel sheet and which is higher than the baking temperature of the topcoat layer, the functional groups in the cross-linking agent are released and cross-linking of the topcoat layer proceeds as the finish coating is baked, thereby strengthening the topcoat layer. In this manner, corrosion resistance of the precoated steel sheet can be highly improved without a sacrifice of formability.

When a cross-linking agent is added, it is used in an amount such that the ratio of the total number of functional groups in the cross-linking agent to the total number of epoxy and hydroxyl groups in the polyhydroxypolyether base resin is at most 2.0:1, preferably in the range of from 0.1:1 to 2.0:1. If this ratio is less than 0.1, the effect of the cross-linking agent will not be significant. On the other hand, if the ratio exceeds 2.0:1, the flexibility of the resulting organic coating will be significantly lost and the coating will tend to readily crack during forming of the precoated sheet, resulting in a substantial decrease in corrosion resistance.

(C) Others:

In addition to the above-described inorganic filler and cross-linking agent, various other additives such as additional resins other than epoxy resins, conductive pigments, plasticizers, and the like may be added to the topcoating composition in order to further improve various properties of the coating, e.g., formability, plasticity or flexibility, electrodeposition coating properties, and weldability.

One such useful additive is a plasticizer which is added to improve the flexibility of the topcoat layer. For this purpose, flexible resins such as a butyral resin can be used. When a butyral resin or other non-reactive plasticizer is added in a large amount, it tends to bleed out of the resin matrix while the precoated steel sheet is exposed to a relatively high temperature for a prolonged period.

Such bleeding of a plasticizer can be effectively prevented by addition of an acrylate or methacrylate ester, preferably a di- or higher functional acrylates or methacrylates, as a reactive plasticizer. Of course, an acrylate or methacrylate may be added by itself as a plasticizer. An acrylate or methacrylate ester plasticizer is finally fixed in the resin matrix through cross-linking caused by cleavage of the double bond in the ester which occurs with the elapse of time. The fixation of the acrylate or methacrylate plasticizer is accelerated when heat is applied to the precoated steel sheet after forming, such as during baking of a finish coating. Acrylate or methacrylate esters which are useful as a reactive plasticizer include pentaerythritol triacrylate or methacrylate, and trimethylolpropane triacrylate or methacrylate.

In order to facilitate electrodeposition applied to the precoated steel sheet for finish coating, a water-soluble resin such as polyvinyl alcohol, polyacrylic or polymethacrylic acid, or acrylamide or methacrylamide may be added.

When one or more additional resins are added as a plasticizer or other additive to the polyhydroxypolyether resin-based topcoating composition, the total amount of additional resins other than polyhydroxypolyether resins should be at most 50% by weight based on the total resin solids in the coating composition in order to avoid a substantial decrease in corrosion resistance of the resulting coating.

The topcoating compositin may also be applied by a conventional method, for example, by use of a wire-wound rod coater or roll coater. The thickness of the organic topcoat layer is in the range of 0.3–10 μm, and preferably 0.3–2.5 μm as a dry film thickness. If the dry film thickness of the topcoat layer is less than 0.3 μm, satisfactory improvement in corrosion resistance and adhesion cannot be achieved and the coating tends to be peeled off during forming. When the precoated steel sheet is to be welded by resistance welding, the thickness of the topcoat layer is preferably at most 2.5 μm, since with a topcoat thickness greater than 2.5 μm it is difficult or even impossible to perform resistance welding on the precoated steel sheet. A precoated steel sheet having an organic topcoat layer with a thickness greater than 10 μm is disadvantageous from an economical viewpoint.

In regard to the organic topcoat layer of the second aspect of the present invention (in which the topcoat layer contains colloidal silica), the topcoat is formed by applying or firing after application a resin-containing solution which contains as a base resin an epoxy resin such as conventionally used and as described above together with colloidal silica in amounts of 10–25% by weight based on the total amount of resin solids and colloidal silica in the resin-containing solution. A solution is applied so as to result in a topcoat of 0.3–1.6 μm in thickness.

The resin-containing solution in this aspect of the present invention further can include a cross-linking agent in an amount such that the molar ratio of the total number of functional groups in the cross-linking agent to the total number of epoxy and hydroxyl groups in the epoxy resin is 0.1 to 2.0:1. In addition, an additional resin other than epoxy resin (such as conventional resins as disclosed above) can be added in an amount of 50% by weight or less based on the total amount of resin solids in the resin-containing solution and in such a fashion that it does not deleteriously effect the properties obtained from the compositions of the present invention.

Regardless of which organic topcoating is used, the wet organic topcoating is formed on the chromate undercoat film is baked at a temperature of from 80° to 300° C. By employing such a baking temperature, it is possible not only to dry the topcoat layer but to accelerate reduction of the chromate ions remaining in the underlying chromate film so as to make the chromate film insoluble and tough.

The baking temperature of the organic topcoat layer is preferably above the boiling temperature of the solvent used in the topcoating composition in order to prevent blocking of the precoated steel sheet product. However, when the dry film thickness of the organic layer is not greater than 5 μm, substantially no blocking will occur even if the baking temperature is below the boiling temperature of the solvent. Therefore, more specifically, the baking temperature is preferably between the boiling temperature of the solvent and 300° C. for a topcoat layer having a dry film thickness of 5–10 μm, and between 80° and 300° C. for a topcoat layer having a dry film thickness of less than 5 μm.

As the baking temperature is elevated, of course, a more uniform coating which exhibits better corrosion resistance and formability is readily obtained. When the steel substrate is of the bake-hardening type, however, the maximum baking temperature is preferably 200° C., since such a steel sheet will lose the desirable bake-hardenability after being heated at a temperature above 200° C. as described above. According to the present invention, since the undercoat chromate film is formed with partially-reduced chromic acid in order to accelerate formation of an insoluble chromate film, it is possible to bake the organic topcoat layer in a relatively low temperature below 200° C.

The thus-prepared precoated steel sheet of the present invention has the following multilayers on the substrate steel sheet: (1) first embodiment: a first or undermost layer of Zn or Zn alloy plating, a second or intermediate layer of a colloidal silica-containing chromate film, and a third or uppermost layer of an organic polyhydroxypolyether resin-based coating; and (b) the second embodiment: a first or an undermost layer of Zn or Zn alloy plating, a second or intermediate layer of a non-colloidal material-containing chromate film, and a third or uppermost layer of an organic epoxy resin-colloidal silica based coating. In the case of a precoated steel sheet for use in automobile bodies, such multilayer coating is typically applied to one surface of the substrate steel sheet. Depending on the end use, of course, it may be applied to both surfaces of the substrate steel sheet.

The following examples illustrate the superior performance of the precoated steel sheet of the present invention. It should be understood, however, that the invention is not limited to the specific details set forth in the examples. In the examples, all the percents are by weight unless otherwise indicted.

EXAMPLE 1

This example illustrates the preparation of precoated steel sheets of the present invention in which the organic topcoat layer contains no inorganic filler or cross-linking agent.

(a) Base steel sheet:

The base steel sheet used in this example was a Zn alloy-electroplated steel sheet comprising a 0.8 mm-thick cold-rolled steel sheet having an electroplated coating of 12% Ni-Zn alloy with a weight of 20 g/m$^2$ on one surface thereof. Prior to use, the base steel sheet was degreased with Fine Cleaner 4336 (manufactured by Nihon Parkerizing) to clean the plated surface.

In some runs, a cold-rolled steel sheet of the bake-hardening type having the same Zn-Ni alloy plating as above on one surface was used as the base steel sheet.

(b) Aqueous suspension for chromating:

To an aqueous chromic acid solution containing 120 g/l of $CrO_3$, ethylene glycol in an aqueous solution was added as a reducing agent and the mixture was heated at 80° C. for 6 hours to partially reduce the chromic acid. After cooling, the reaction mixture was diluted with an aqueous chromic acid solution containing 40 g/l of $CrO_3$ in an amount sufficient to adjust the $Cr^{3+}/(Cr^{3+}+Cr^{6+})$ ratio to a predetermined value. The aqueous solution of partially-reduced chromic acid was further diluted with water sufficient to adjust the concentration of total chromic acid (total Cr concentration as $CrO_3$) to 40 g/l (0.4M as $CrO_3$).

To the resulting aqueous solution of partially reduced chromic acid, a predetermined amount of colloidal silica having an average particle diameter of 12 nm (Aerosil 200 manufactured by Nippon Aerosil) was added.

In some runs, one or more of the following optional additives were added in predetermined amounts:

Silane coupling agent:

- Vinyltriethoxysilane (A-151 manufactured by Nippon Unicar);
- Gamma-glycidoxypropyltrimethoxysilane (A-187 manufactured by Nippon Unicar);
- Gamma-aminopropyltriethoxysilane (A-1101 manufactured by Nippon Unicar);

Polyhydric alcohol:

- Glycerol (reagent grade);

Oxycarboxylic acid:

- Citric acid (reagent grade);

Iron phosphide powder:

- Ferrous (II) phosphide ($(Fe_2)P$) powder having an average particle diameter of 3 μm (HRS-2132 manufactured by Occidental Chemical); and Metal chromate:

- Strontium chromate (reagent grade).

The resulting mixture was thoroughly agitated by a High-Speed Disper to form an aqueous suspension prior to use.

(c) Polyhydroxypolyether resin-based coating composition:

A flask fitted with a condenser was charged with 230 parts by weight of bisphenol A diglycidyl ether (Epikote 828 manufactured by Yuka Shell Epoxy), 55 parts by weight of resorcinol, 200 parts by weight of methyl ethyl ketone, and 4 parts by volume of an aqueous 5N NaOH solution. The mixture was heated to reflux and allowed to react at that temperature for 18 hours. The resulting resinous mass was poured into water and stirred to precipitate a water-insoluble resin. The precipitates were collected by filtration and dried in vacuo to yield a high molecular-weight polyhydroxypolyether resin having a number-average molecular weight of approximately 35,000 as powder in which the dihydric phenol component was comprised of an equimolar mixture of resorcinol (mononuclear) and bisphenol A (dinuclear).

The powdery high molecular-weight polyhydroxypolyether resin obtained above was dissolved in a mixed solvent of cellosolve acetate and cyclohexanone (1/1 by volume) to form a resin solution containing 20% resin solids.

In the cases where the resin topcoat layer was baked at a low temperature below 100° C., a resin solution having the same resin solids content as above was prepared by using methyl ethyl ketone as a solvent.

A commercially-available high molecular-weight polyhydroxypolyether resin in which the dihydric phenol component was a dinuclear phenol (bisphenol A), i.e., Bakelite (registered trademark) phenoxy resin PKHH manufactured by Union Carbide (molecular weight about 30,000) was also used in some runs and it was dissolved in the same mixed solvent as above to form a resin solution having 20% resin solids content.

As a reactive plasticizer, pentaerythritol triacrylate (Aronix M-305 manufactured by Toa Gosei Chemical) was added to some resin solutions.

(d) Preparation of precoated steel sheet:

On a cleaned plated surface of the above-mentioned base steel sheet, the aqueous suspension prepared in (b) above which contained partially-reduced chromic acid, colloidal silica and optionally one or more other additives was applied by a wire-wound rod coater at varying coating weights, and the coated steel sheet was then baked for 30 seconds at a predetermined temperature of the steel sheet to form a colloidal silica-containing chromate film on the plated surface. After the steel sheet was allowed to cool to room temperature, the resin solution preared in (c) above was applied with varying thicknesses on the chromate film by a wire-wound rod coater and baked for 60 seconds at a predetermined temperature of the steel sheet to form an organic topcoat layer.

The thus-prepared precoated steel sheet was evaluated with respect to corrosion resistance, formability, and weldability by the testing procedures described below. For the precoated steel sheets in which the substrate steel was of the bake-hardening type, the bake-hardenability of the precoated steel sheets was also evaluated.

(e) Testing procedures:

(i) Corrosion resistance:

The corrosion resistance of the precoated steel sheet was evaluated by an altenate wet and dry test in which a test piece of the precoated steel sheet was subjected to repeated cycles consisting of dipping in 5% NaCl solution at 35° C. for 1 hour and subsequent air drying at 50° C. for 1 hour. After exposure to 480 cycles (total exposure period: 960 hours), the percent area of blisters observed on the coating and the average diameter of the blisters were determined as measures of corrosion resistance.

Figure 2:
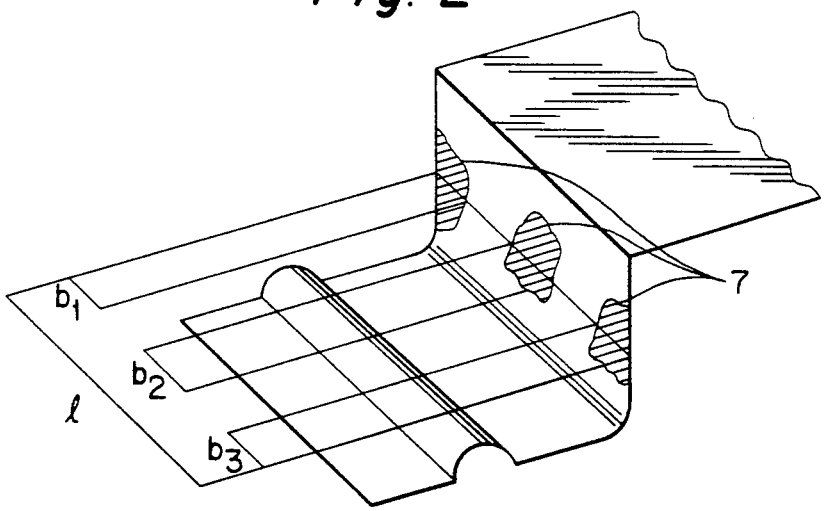
FIG. 2 is a schematic perspective view showing the method of evaluating the percent area of the peeled off coating in the U-bend press forming test.

(ii) Formability (adhesion after press forming):

In order to evaluate formability of the precoated steel sheet, a test piece was subjected to a beaded U-bend press forming test shown in FIG. 1. In FIG. 1 only the left half of the test piece is shown because the right half is the same. Referring to FIG. 1, on a die 1 a test piece 2 having a coating 3 on one surface was placed with the coating 3 facing the die 1 and was supported with the aid of a spacer 4 by a blank holder 5. Thereafter a punch 6 was forced downward as indicated by the arrow to perform press forming on the test piece between the die and punch so as to make a U-bend. As shown in FIG. 2, the evaluation was made by determining the percent area of peeled-off portions 7 of the coating produced by the U-bend forming, which was calculated by the following equation:

$$\% \text{ Area of peeled coating} = \frac{\Sigma b_i}{2l} \times 100$$

Although only a half of the test piece is shown in FIGS. 1 and 2, the percent area of peeled-off coating was calculated by the above equation based on the measurements of the entire test piece. The die shoulders were cleansed with trichloroethylene and polished with a #120 Emery paper prior to each press forming test in order to keep a constant surface roughness of the shoulder portions.

(iii) Weldability:

Two test pieces of each precoated steel sheet were placed one on the other with the coated surface of one test piece facing the uncoated surface of the other, and spot welding was performed thereon with an AC single spot welder with electrodes having a tip diameter of 5.0 mm by impressing a welding current of 8000A for 10 cycles under a load of 200 kg. The weldability was evaluated as follows:

○: Completely welded with no surface flashes;

Δ: Completely welded with surface flashes;

X: Incompletely welded or unwelded.

(iv) Bake-hardenability:

A test piece of a precoated steel sheet was stretched with 2% elongation and then heated at 170° C. for 30 minutes. The tensile properties of the heated test piece were determined and the bake-hardenability was evaluated in terms of the difference of the yield stress (yield point) before heating substracted from that after heating.

The results are summarized in Tables 1-3 below, in which Table 1 shows the compositions, weight or thickness, and baking temperatures of the undercoat chromate layer and the organic topcoat layer employed in the preparation of each precoated steel sheet. The run numbers bearing an asterisk indicate comparative examples in which one or more parameters are outside the ranges defined herein.

Table 2 shows the test results for corrosion resistance, press formability, and weldability of each precoated steel sheet. Table 3 shows the test results for bake-hardenability of a precoated steel sheet having a substrate steel of the bake-hardening type. The chemical composition of the bake-hardening-type steel used as a substrate is also shown in Table 3.

EXAMPLE 2

This example illustrates the preparation of precoated steel sheets in which the organic topcoat layer contains an inorganic filler and/or a cross-linking agent.

(a) Base steel sheet:

The base steel sheet used in this example was the same as that used in Example 1. Namely, it was comprised of a 0.8 mm-thick cold-rolled steel sheet having an electroplated coating of 12% Ni-Zn alloy with a weight of 20 g/m$^2$ on one surface thereof. Prior to use, the base steel sheet was degreased with Fine Cleaner 4336 (manufactured by Nihon Parkerizing) to clean the plated surface.

(b) Aqueous suspension for chromating:

To an aqueous chromic acid solution containing 120 g/l of $CrO_3$, an aqueous ethylene glycol solution was added as a reducing agent and the mixture was heated at 80° C. for 6 hours to partially reduce the chromic acid. After cooling, the reaction mixture was diluted with an aqueous chromic acid solution containing 40 g/l of $CrO_3$ in an amount sufficient to adjust the $Cr^{3+}/Cr^{6+}$ ratio to $\frac{2}{3}$ [$Cr^{3+}/(Cr^{3+}+Cr^{6+})=0.4$]. The aqueous solution of partially-reduced chromic acid was further diluted with water sufficient to adjust the concentration of total chromic acid to 40 g/l (0.4M as $CrO_3$).

To the resulting aqueous solution of partially reduced chromic acid, the following additives were added:

(a) 40 g/l of colloidal silica having an average particle diameter of 12 nm (Aerosil 200 manufactured by Nippon Aerosil);

(b) 11.5 g/l of glycerol as a polyhydric alcohol;

(c) 6.5 g/l of citric acid as a hydroxycarboxylic acid;

(d) 15 g/l of gamma-glycidoxypropyltrimethoxysilane as a silane coupling agent; and (e) a predetermined amount of iron phosphide ($Fe_2P$) powder having an average particle diameter of 3 μm (HRS-2132 manufactured by Occidental Chemical).

In some runs, (f) strontium chromate as a metal chromate was also added in a predetermined amount.

The resulting mixture was thoroughly agitated by a High-Speed Disper to form an aqueous suspension prior to use.

(c) Polyhydroxypolyether resin-based coating composition:

The polyhydroxypolyether resins used in this example were the same as those employed in Example 1. Namely, one was a powdery high molecular-weight polyhydroxypolyether resin having a number-average molecular weight of approximately 35,000 prepared as described in Example 1 in which the dihydric phenol component was comprised of resorcinol (mononuclear) and bisphenol A (dinuclear) at a molar ratio of 1:1, and the other was the commercially-available Bakelite phenoxy resin PKHH described in Example 1 (M.W.=about 30,000) in which the dihydric phenol component was comprised solely of dinuclear bisphenol A. These resins were dissolved in the same manner as described in Example 1 to form coating compositions.

When a cross-linking agent (blocked isocyanate) and/or a plasticizer (butyral resin) was incorporated in the resin solution, it was added with stirring. When an inorganic filler was added to the resin solution, it was dispersed in the solution by using glass beads of 2 mm in diameter in a sand mill as follows: A predetermined amount of the inorganic filler was added to 80 g of the resin solution and the mixture was stirred with the glass beads for 10–30 minutes until there was no particle larger than 5 μm in diameter as measured by a grindometer.

(d) Preparation of precoated steel sheet:

On a clean plated surface of the above-mentioned base steel sheet, the aqueous suspension prepared in (b) above was applied by a wire-wound rod coater with varying coating weights, and the coated steel sheet was then baked for 30 seconds at a temperature of the steel sheet between 120°–140° C. to form a colloidal silica-containing chromate film. After the steel sheet was allowed to cool to room temperature, the resin solution prepared in (c) above was applied with varying thicknesses on the chromate film by a wire wound rod coater and baked for 60 seconds at a predetermined temperature of the steel sheet to form an organic topcoat layer.

The thus-prepared precoated steel sheet was evaluated with respect to corrosion resistance, formability, electrodeposition coating property, weldability, and chromium solve-out according to the testing procedures described below.

(e) Testing procedures:

(i) Corrosion resistance:

The corrosion resistance of each precoated steel sheet was measured with a flat test piece with no working applied thereto and a test piece which had been subjected to cylindrical deep drawing with a diameter of 50 mm. The shoulder of the die used in the cylindrical drawing was washed with trichloroethylene and polished with a #120 Emery paper prior to each test so as to maintain a constant surface roughness of the shoulder portion. Both test pieces were immersed in a degreasing solution FC-4357 (manufactured by Nihon Parkerizing) at 60° C. for 2 minutes, then rinsed with water, and dried by heating at 165° C. for 25 minutes. Thereafter, each test piece was subjected to an altenate wet and dry test in which the test piece was exposed to repeated cycles consisting of salt spraying with a 5% NaCl solution at 35° C. for 4 hour, air drying at 60° C. for 2 hour, and exposure to a wet atmosphere at 50° C. and 95% relative humidity for 2 hours. After exposure to 200 cycles (total exposure period: 1600 hours), the percent of the coating area covered by red rust was determined as a measure of corrosion resistance.

(ii) Formability (adhesion after press forming):

Formability was evaluated in the same manner as described in Example 1-(ii).

(iii) Electrodeposition coating property:

A test piece was degreased in the same manner as described in the Corrosion Resistance Test (i) above. Subsequently, electrodeposition coating was applied to the coated surface of the test piece using a coating composition U-100 (manufactured by Nippon Paint) under such conditions that a 20 μm-thick coating would be deposited on a cold-rolled steel sheet which had been treated by chemical conversion (usually for 3 minutes at 200 V), and the electrodeposited coating was baked at 165° C. for 25 minutes. The appearance of the electrodeposited coating was visually evaluated and assigned the following ratings:

○: Good appearance

Δ: Significantly roughened surface;

X: Formation of craters or incapable of electrodeposition.

Secondary adhesion of the electrodeposited coating was also evaluated by the cross cut adhesion peeling test after the test piece was immersed in warm water at 40° C. for 10 days. When all the cross-cut sections of the coating remained on the steel sheet after the peeling test, the rating "○" was assigned.

(iv) Weldability:

Two test pieces of each precoated steel sheet were placed one on the other with the coated surface of one test piece facing the uncoated surface of the other, and spot welding was performed thereon with an AC single spot welder with electrodes having a tip diameter of 5.0 mm by impressing a welding current of 8000A for 12 cycles under a load of 200 kg. The weldability was evaluated as follows:

○: Weldable with 5000 consecutive spots

Δ: Weldable with less than 5000 consecutive spots

X: Non-weldable (v) Chromium solve-out:

Two test pieces of each precoated steel sheet were immersed in a degreasing solution FC-L4410 (manufactured by Nihon Parkerizing) at 43° C. for 2 minutes and 30 seconds, and thereafter one of the test pieces was further immersed in a zinc phosphate-containing chemical conversion solution PB-L3020 (manufactured by Nihon Parkerizing) at 43° C. for 2 minutes. The weight of chromium dissolved out of the coating into each solution during immersion was determined based on the measurements of the Cr weight of the coating before and after the immersion which were carried out by fluorescent X-ray analysis.

The compositions, weight or thickness, and baking temperatures of the undercoat chromate layer and the organic topcoat layer employed in the preparation of each precoated steel sheet are summarized in Table 4, while Table 5 shows the test results for each precoated steel sheet. The run numbers bearing an asterisk indicate comparative examples in which one or more parameters are outside the range defined herein.

EXAMPLE 3

This example illustrates the preparation of precoated steel sheets of the present invention in which the organic topcoat layer contains colloidal silica and the undercoat is free from colloidal silica.

(a) Base steel sheet:

The base steel sheet used in this example was a Zn alloy-electroplated steel sheet comprising a 0.8 mm-thick cold-rolled steel sheet having an electroplated coating of 12% Ni-Zn alloy with a weight of 20 g/m$^2$ on one surface thereof. Prior to use, the base steel sheet was degreased with Fine Cleaner 4336 (manufactured by Nihon Parkerizing) to clean the plated surface.

(b) Aqueous suspension for chromating:

To an aqueous chromic acid solution containing 120 g/l of $CrO_3$, ethylene glycol in an aqueous solution was added as a reducing agent and the mixture was heated at 80° C. for 6 hours to partially reduce the chromic acid. After cooling, the reaction mixture was diluted with an aqueous chromic acid solution containing 40 g/l of $CrO_3$ in an amount sufficient to adjust the $Cr^{3+}/(Cr^{3+}+Cr^{6+})$ ratio to a predetermined value.

The aqueous solution of partially-reduced chromic acid was further diluted with water sufficient to adjust the concentration of total chromic acid (total Cr concentration as $CrO_3$) to 40 g/l (0.4M as $CrO_3$).

To the resulting aqueous solution of partially reduced chromic acid, a predetermined amount of glycerol (polyhydric alcohol) as a reducing agent.

In some, runs as a silane coupling agent gamma-glycidoxypropyltrimethoxysilane was added.

For comparison an aqueous solution for chromating which contains colloidal silica was prepared.

(c) Polyhydroxypolyether resin-based coating composition:

A flask fitted with a condenser was charged with 230 parts by weight of bisphenol A diglycidyl ether (Epikote 828 manufactured by Yuka Shell Epoxy), 55 parts by weight of resorcinol, 200 parts by weight of methyl ethyl ketone, and 4 parts by volume of an aqueous 5N NaOH solution. The mixture was heated to reflux and allowed to react at that temperature for 18 hours. The resulting resinous mass was poured into water and stirred to precipitate a water-insoluble resin. The precipitates were collected by filtration and dried in vacuo to yield a high molecular-weight polyhydroxypolyether resin having a number-average molecular weight of approximately 35,000 as powder in which the dihydric phenol component was comprised of an equimolar mixture of resorcinol (mononuclear) and bisphenol A (dinuclear) in a molar ratio of 1/1 (hereunder referred as Resin-A).

The powdery high molecular-weight polyhydroxypolyether resin obtained above was dissolved in a mixed solvent of cellosolve acetate and cyclohexanone (1/1 by volume) to form a resin solution containing 20% resin solids.

A commercially-available high molecular-weight polyhydroxypolyether resin in which the dihydric phenol component was a dinuclear phenol (bisphenol A), i.e., Bakelite (registered trademark) phenoxy resin PKHH manufactured by Union Carbide (molecular weight about 30,000) was also used in some runs and it was dissolved in the same mixed solvent as above to form a resin solution having 20% resin solids content (hereunder referred to as Resin-B).

As a general-purpose expoxy resin, Epikote 1009 (molecular weight of 3750) by Yuka Shell was dissolved in a xylene/methyl ethyl keton solvent (weight ratio 6/4) to form a resin-containing solution (hereunder referred to as Resin-C).

Colloidal silica (average particle size 10–20 mμ, "Oskal 1432", trade name of Shokubai Kasei Co. Ltd.), a cross-linking agent (blocked isocyanate having a dissociation temperature of 80° C. for Resin-A and -B, and phenol resin for Resin-C), and a plasticizer (butyral resin) were added, mixed, and dispersed in the resin-containing solution.

(d) Preparation of precoated steel sheet:

On a cleaned plated surface of the above-mentioned base steel sheet, the aqueous suspension prepared in (b) above which contained partially-reduced chromic acid, and optionally one or more other additives was applied by a wire-wound rod coater at varying coating weights, and the coated steel sheet was then baked for 30 seconds at a temperature of the steel sheet of 140° C. to form a chromate film on the plated surface. After the steel sheet was allowed to cool to room temperature, the resin solution prepared in (c) above was applied with varying thicknesses on the chromate film by a wire-wound rod coater and baked for 60 seconds at a temperature of the steel sheet of 140° C. to form an organic topcoat layer.

The thus-prepared precoated steel sheet was evaluated with respect to corrosion resistance, electrodeposition applicability, solving-out of chromium, and weldability by the testing procedures described below.

(i)) Weldability:

Two test pieces of each precoated steel sheet were placed one on the other with the coated surface of one test piece facing the uncoated surface of the other, and spot welding was performed thereon with an AC single spot welder with electrodes having a tip diameter of 6.0 mm by impressing a welding current of 10000 A for 12 cycles under a load of 200 kg. The weldability was evaluated as follows:

(A) Uniformness of welding spots:

After performing spot welding with consecutive 1,000 spots, 100 spot samples were taken at random out of 1,000 spots. The number of irregular spots which were caused by local concentration of current was determined.

Figure 3A:
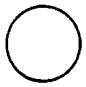
FIGS. 3*a* and 3*b* are plan views of two welded test pieces.
Figure 3B:
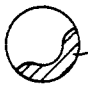

FIG. 3 schematically shows welding spots; one is good and the other one is bad.

(B) Applicability of spot welding:

After performing spot welding with 1,000 consecutive spots, the diameter of the electrode was measured:

0: Diameter $<$ 7.0 mm

Δ: Diameter = 7.0–8.0 mm

X: Diameter $>$ 8.0 mm (ii) Corrosion resistance:

The corrosion resistance of each precoated steel sheet was measured with a flat test piece with no working applied thereto and a test piece which had been subjected to cylindrical deep drawing with a diameter of 50 mm. The shoulder of the die used in the cylindrical drawing was washed with trichloroethylene and polished with a #120 Emery paper prior to each test so as to maintain a constant surface roughness of the shoulder portion. Both test pieces were immersed in a degreasing solution FC-L4410 (manufactured by Nihon Parkerizing) at 43° C. for 2.5 minutes, then rinsed with water, and dried by heating at 165° C. for 25 minutes. Thereafter, each test piece was subjected to an altenate wet and dry test in which the test piece was exposed to repeated cycles consisting of salt spraying with a 5% NaCl solution at 35° C. for 4 hour, air drying at 60° C. for 2 hour, and exposure to a wet atmosphere at 50° C. and 95% relative humidity for 2 hours. After exposure to 200 cycles (total exposure period: 1600 hours), the percent of the coating area covered by red rust was determined as a measure of corrosion resistance.

(iii) Electrodeposition coating property:

A test piece was degreased in the same manner as described in the Corrosion Resistance Test (i) above. Subsequently, electrodeposition coating was applied to the coated surface of the test piece using a coating composition U-100 (manufactured by Nippon Paint) under such conditions that a 20 μm-thick coating would be deposited on a cold-rolled steel sheet which had been treated by chemical conversion (usually for 3 minutes at 200 V), and the electrodeposited coating was baked at 165° C. for 25 minutes. The appearance of the electrodeposited coating was visually evaluated and assigned the following ratings:

○: Good appearance

Δ: Significantly roughened surface;

X: Formation of craters or incapable of electrodeposition.

(iv) Chromium solve-out:

Two test pieces of each precoated steel sheet were immersed in a degreasing solution FC-L4410 (manufactured by Nihon Parkerizing) at 43° C. for 2 minutes and 30 seconds, and thereafter one of the test pieces was further immersed in a zinc phosphate-conataining chemical conversion solution PB-L3020 (manufactured by Nihon Parkerizing) at 43° C. for 2 minutes. The weight of chromium dissolved out of the coating into each solution during immersion was determined based on the measurements of the Cr weight of the coating before and after the immersion which were carried out by fluorescent X-ray analysis.

The test results are summarized in Table 6.

TABLE 1

| | Undercoat chromate layer (Cr weight, Cr reduction rate, amounts of additives, baking temp.) | | | | | | | | | Organic topcoat layer | | | |
|---|---|---|---|---|---|---|---|---|---|---|---|---|---|
| Run No. | Cr weight ($mg/m^3$ as Cr) | Cr reduction $Cr^{3+}/(Cr^{3+}+Cr^{6+})$ | Colloidal silica[1)] | Silane coupling agent[2),5)] | Glycerol[2)] | Citric acid[2)] | $Fe_2P$[1)] | $SrCrO_4$[1)] | Baking temp. (°C.) | Base resin[3)] | Reactive plasticizer[4)] | Dry film thickness (μm) | Baking temp. (°C.) |
| 1 | 50 | 0.4 | 1.5 | 0.1 G | | | | | 100 | A | | 1 | 120 |
| 2 | 100 | 0.4 | 1.5 | 0.1 G | | | | | 100 | A | | 1 | 120 |
| 3 | 200 | 0.4 | 1.5 | 0.1 G | | | | | 100 | A | | 1 | 120 |
| 4 | 300 | 0.4 | 1.5 | 0.1 G | | | | | 100 | A | | 1 | 120 |
| 5 | 100 | 0.4 | 1.5 | | 0.1 | | | | 100 | A | | 1 | 120 |
| 6 | 100 | 0.4 | 1.5 | | | 0.1 | | | 100 | A | | 1 | 120 |
| 7 | 100 | 0.4 | 1.5 | 0.1 G | 0.1 | 0.1 | | | 100 | A | | 1 | 120 |
| 8 | 100 | 0.4 | 1.5 | 0.1 V | | | | | 60 | A | | 1 | 120 |
| 9 | 100 | 0.4 | 1.5 | | 0.1 | | | | 60 | A | | 1 | 120 |
| 10 | 100 | 0.4 | 1.5 | | | 0.1 | | | 60 | A | | 1 | 120 |
| 11 | 100 | 0.4 | 1.5 | 0.1 V | 0.1 | 0.1 | | | 60 | A | | 1 | 120 |
| 12 | 100 | 0.4 | 1.5 | 0.01 A | | | | | 100 | A | | 1 | 120 |
| 13 | 100 | 0.4 | 1.5 | | 0.01 | | | | 100 | A | | 1 | 120 |
| 14 | 100 | 0.4 | 1.5 | | | 0.01 | | | 100 | A | | 1 | 120 |
| 15 | 100 | 0.4 | 1.5 | 0.01 A | 0.01 | 0.01 | | | 100 | A | | 1 | 120 |
| 16 | 100 | 0.1 | 1.5 | | | | | | 100 | A | | 1 | 120 |
| 17 | 100 | 0.1 | 1.5 | 0.1 A | 0.1 | 0.1 | | | 100 | A | | 1 | 120 |
| 18 | 100 | 0.4 | 0.5 | | | | | | 100 | A | | 1 | 120 |
| 19 | 100 | 0.4 | 1.5 | | | | | | 100 | A | | 1 | 120 |
| 20 | 100 | 0.4 | 5.0 | | | | | | 100 | A | | 1 | 120 |
| 21 | 100 | 0.4 | 0.5 | 0.1 A | 0.1 | 0.1 | | | 100 | A | | 1 | 120 |
| 22 | 100 | 0.4 | 5.0 | 0.1 A | 0.1 | 0.1 | | | 100 | A | | 1 | 120 |
| 23 | 100 | 0.4 | 1.5 | 0.1 A | 0.3 | 0.3 | | | 100 | A | | 1 | 120 |
| 24 | 300 | 0.4 | 1.5 | | | | 5 | | 100 | A | | 1 | 120 |
| 25 | 100 | 0.4 | 1.5 | 0.1 G | | | 5 | | 100 | A | | 1 | 120 |
| 26 | 100 | 0.4 | 1.5 | | 0.1 | | 5 | | 100 | A | | 1 | 120 |
| 27 | 100 | 0.4 | 1.5 | | | 0.1 | 5 | | 100 | A | | 1 | 120 |
| 28 | 100 | 0.4 | 1.5 | 0.1 G | 0.1 | 0.1 | 5 | | 100 | A | | 1 | 120 |
| 29 | 100 | 0.4 | 1.5 | 0.1 G | 0.1 | 0.1 | 1 | | 100 | A | | 1 | 120 |
| 30 | 100 | 0.4 | 1.5 | 0.1 G | 0.1 | 0.1 | 10 | | 100 | A | | 1 | 120 |
| 31 | 100 | 0.4 | 1.5 | 0.1 G | 0.1 | 0.1 | 5 | 0.4 | 100 | A | | 1 | 120 |
| 32 | 100 | 0.4 | 1.5 | 0.1 G | 0.1 | 0.1 | | | 100 | A | | 5 | 120 |
| 33 | 100 | 0.4 | 1.5 | 0.1 G | 0.1 | 0.1 | 5 | | 100 | A | | 5 | 120 |
| 34 | 100 | 0.4 | 1.5 | 0.1 G | 0.1 | 0.1 | 5 | | 100 | A | | 10 | 150 |
| 35 | 100 | 0.4 | 1.5 | | | | | | 100 | A | 1 | 1 | 120 |
| 36 | 100 | 0.4 | 1.5 | | | | | | 100 | A | 5 | 1 | 120 |
| 37 | 100 | 0.4 | 1.5 | | | | | | 100 | A | 10 | 1 | 120 |
| 38 | 100 | 0.4 | 1.5 | | | | | | 100 | A | 20 | 1 | 120 |
| 39 | 100 | 0.4 | 5.0 | 0.1 G | 0.1 | 0.1 | 5 | 0.4 | 100 | A | 10 | 1 | 120 |
| 40 | 100 | 0.4 | 1.5 | 0.1 G | 0.1 | 0.1 | | | 100 | A | 10 | 1 | 120 |
| 41 | 100 | 0.4 | 1.5 | | | | | | 100 | B | 1 | 1 | 120 |
| 42 | 100 | 0.4 | 1.5 | | | | | | 100 | B | 5 | 1 | 120 |
| 43 | 300 | 0.4 | 1.5 | | | | | | 100 | B | 10 | 1 | 120 |
| 44 | 100 | 0.4 | 1.5 | | | | | | 100 | A | 20 | 1 | 120 |
| 45 | 100 | 0.4 | 1.5 | 0.1 G | 0.1 | 0.1 | 5 | 0.4 | 80 | A | | 1 | 80 |
| 46 | 100 | 0.4 | 1.5 | 0.1 G | 0.1 | 0.1 | 5 | 0.4 | 120 | A | | 1 | 120 |
| 47 | 100 | 0.4 | 1.5 | 0.1 G | 0.1 | 0.1 | 5 | 0.4 | 150 | A | | 1 | 150 |
| 48 | 100 | 0.4 | 1.5 | 0.1 G | 0.1 | 0.1 | 5 | 0.4 | 180 | A | | 1 | 180 |
| 49* | 100 | 0.05** | 1.5 | | | | | | 100 | A | | 1 | 120 |

TABLE 1-continued

| Run No. | Undercoat chromate layer (Cr weight, Cr reduction rate, amounts of additives, baking temp.) | | | | | | | | | Organic topcoat layer | | | |
|---|---|---|---|---|---|---|---|---|---|---|---|---|---|
| | Cr weight ($mg/m^3$ as Cr) | Cr reduction $Cr^{3+}/(Cr^{3+}+Cr^{6+})$ | Colloidal silica[1)] | Silane coupling agent[2),5)] | Glycerol[2)] | Citric acid[2)] | $Fe_2P$[1)] | $SrCrO_4$[1)] | Baking temp. (°C.) | Base resin[3)] | Reactive plasticizer[4)] | Dry film thickness (μm) | Baking temp. (°C.) |
| 50* | 100 | 0.4 | 0.01** | | | | | | 100 | A | | 1 | 120 |
| 51* | 5** | 0.4 | 1.5 | 0.1 G | 0.1 | 0.1 | | | 100 | A | | 1 | 120 |
| 52* | 630** | 0.4 | 1.5 | 0.1 G | 0.1 | 0.1 | | | 100 | A | | 1 | 120 |
| 53* | 100 | 0.4 | 1.5 | 0.1 G | 0.1 | 0.1 | 5 | | 100 | A | | 15** | 150 |
| 54* | 100 | 0.4 | 7.0** | | | | | | 100 | A | | 1 | 120 |
| 55* | 100 | 0.4 | 1.5 | | 3.0** | | | | 100 | A | | 1 | 120 |
| 56* | 100 | 0.4 | 1.5 | | | 3.0** | | | 100 | A | | 1 | 120 |
| 57* | 100 | 0.4 | 1.5 | 0.1 G | 0.1 | 0.1 | 5 | 0.4 | 210** | A | | 1 | 210** |
| 58* | 100 | 0.4 | —** | 0.1 G | 0.1 | 0.1 | 5 | 0.4 | 100 | A | | 1 | 120 |

(Notes)

1)Weight ratio relative to total chromic acid (excluding $SrCrO_4$); Regarding the amount of $SrCrO_4$, the weight ratio of $SrCrO_4$/total chromic acid of 0.4 indicated in the table corresponds to the molar ratio of $SrCrO_4$/unreduced chromic acid of 0.46.

2)Molar ratio relative to residual unreduced chromic acid ($Cr^{6+}$);

3)Base resin; A = High molecular-weight polyhydroxypolyether resin in which the dihydric phenol is comprised of resorcinol and bisphenol A in a molar ratio of 1:1; B = High molecular-weight polyhydroxypolyether resin derived from bisphenol A as a dihydric phenol;

4)Reactive plasticizer: pentaerythritol triacrylate; Weight % based on the total resin solids;

5)Silane coupling agent: V = Vinyltriethoxysilane; G = γ-Glycidoxypropyltrimethoxysilane; A = γ-Aminopropyltriethoxysilane.

**Outside the range defined herein.

In the precoated steel sheets of Runs Nos. 45-48 and 57, the substrate steel sheet used was made from a steel of the bake-hardening type.

TABLE 2

| Run No. | Corrosion resistance: % Area of blisters | Corrosion resistance: Blister diameter | Formability: % Area of peeled-off coating | Weld-ability |
|---|---|---|---|---|
| 1 | 5 | 0.5 | 0 | Δ |
| 2 | 0 | — | 0 | Δ |
| 3 | 0 | — | 0 | Δ |
| 4 | 0 | — | 5 | Δ |
| 5 | 0 | — | 0 | Δ |
| 6 | 0 | — | 2 | Δ |
| 7 | 0 | — | 0 | Δ |
| 8 | 5 | 0.5 | 2 | Δ |
| 9 | 5 | 0.5 | 2 | Δ |
| 10 | 5 | 0.5 | 2 | Δ |
| 11 | 2 | 0.5 | 0 | Δ |
| 12 | 5 | 0.5 | 5 | Δ |
| 13 | 5 | 0.5 | 5 | Δ |
| 14 | 5 | 0.5 | 5 | Δ |
| 15 | 5 | 0.5 | 2 | Δ |
| 16 | 10 | 0.5 | 5 | Δ |
| 17 | 5 | 0.5 | 2 | Δ |
| 18 | 10 | 0.5 | 10 | Δ |
| 19 | 10 | 0.5 | 5 | Δ |
| 20 | 5 | 0.5 | 10 | Δ |
| 21 | 2 | 0.5 | 5 | Δ |
| 22 | 0 | — | 5 | Δ |
| 23 | 0 | — | 0 | Δ |
| 24 | 2 | 0.5 | 5 | ○ |
| 25 | 2 | 0.5 | 0 | ○ |
| 26 | 2 | 0.5 | 0 | ○ |
| 27 | 2 | 0.5 | 0 | ○ |
| 28 | 0 | — | 0 | ○ |
| 29 | 0 | — | 0 | ○ |
| 30 | 0 | — | 0 | ○ |
| 31 | 0 | — | 0 | ○ |
| 32 | 0 | — | 0 | Δ |
| 33 | 0 | — | 0 | ○ |
| 34 | 0 | — | 0 | Δ |
| 35 | 5 | 0.5 | 2 | Δ |
| 36 | 2 | 0.5 | 0 | Δ |
| 37 | 2 | 0.5 | 0 | Δ |
| 38 | 2 | 0.5 | 0 | Δ |
| 39 | 0 | — | 0 | ○ |
| 40 | 0 | — | 0 | Δ |

TABLE 2-continued

| Run No. | Corrosion resistance: % Area of blisters | Corrosion resistance: Blister diameter | Formability: % Area of peeled-off coating | Weld-ability |
|---|---|---|---|---|
| 41 | 10 | 0.5 | 5 | Δ |
| 42 | 5 | 0.5 | 0 | Δ |
| 43 | 5 | 0.5 | 0 | Δ |
| 44 | 5 | 0.5 | 0 | Δ |
| 45 | 5 | 0.5 | 0 | ○ |
| 46 | 0 | — | 0 | ○ |
| 47 | 0 | — | 0 | ○ |
| 48 | 0 | — | 0 | ○ |
| 49* | 40 | 3 | 20 | Δ |
| 50* | 10 | 0.5 | 30 | Δ |
| 51* | 60 | 3 | 10 | Δ |
| 52* | 0 | — | 50 | Δ |
| 53* | 0 | — | 0 | X |
| 54* | 0 | — | 60 | Δ |
| 55* | 30 | 3 | 0 | Δ |
| 56* | 30 | 3 | 0 | Δ |
| 57* | — | — | — | — |
| 58* | 20 | 2 | 30 | O |

TABLE 3

| Composition of bake hardening-type steel (weight %) | | | | | | |
|---|---|---|---|---|---|---|
| C | Si | Mn | P | S | sol.Al | N |
| 0.01 | 0.02 | 0.12 | 0.075 | 0.005 | 0.0049 | 0.0069 |

| Tensile properties and bake-hardenability | | | | | |
|---|---|---|---|---|---|
| Run No. | Yield point (kgf/mm²) | Tensile strength (kgf/mm²) | Elon-gation (%) | YPE[1] (%) | Bake hard-enability (kgf/mm²) |
| 45 | 20.5 | 35.6 | 39.2 | 0 | 4.3 |
| 46 | 20.5 | 35.2 | 39.5 | 0 | 4.3 |
| 47 | 20.5 | 35.2 | 39.0 | 0 | 4.5 |
| 48 | 21.0 | 35.4 | 39.2 | 0.2 | 4.5 |
| 57* | 23.0 | 35.5 | 36.2 | 0.8 | 1.5 |
| Unbaked stock | 20.0 | 35.2 | 40.1 | 0 | 4.3 |

(Note)
[1]YPE: Yield point elongation

TABLE 4

| Run No. | Undercoat chromate layer: Cr weight (mg/ni as Cr) | $Fe_2P$[1] | $SrCrO_4$[1] | Organic topcoat layer: Base Resin[2] | Inorganic filler: Class[3] | Inorganic filler: vol %[4] | Cross-link. agent: Class[4] | Cross-link. agent: Amount[5] | Polybutyral plasticizer (weight %)[6] | Dry film thickness (μm) | Baking temp. (°C.) |
|---|---|---|---|---|---|---|---|---|---|---|---|
| 1 | 60 | 5 | — | A | Zn phosphate | 10 | — | — | — | 1.2 | 130 |
| 2 | 60 | 5 | — | A | Ca phosphate | 10 | — | — | — | 1.2 | 130 |
| 3 | 60 | 5 | — | A | Zn phospho-molybdate | 10 | — | — | — | 1.2 | 130 |
| 4 | 60 | 5 | — | A | Al phospho-molybdate | 10 | — | — | — | 1.2 | 130 |
| 5 | 60 | 5 | — | A | silica A | 5 | — | — | — | 1.2 | 130 |
| 6 | 60 | 5 | — | A | silica A | 10 | — | — | — | 1.2 | 130 |
| 7 | 60 | 5 | — | A | silica A | 15 | — | — | — | 1.2 | 130 |
| 8 | 60 | 5 | — | A | silica B | 5 | — | — | — | 1.2 | 130 |
| 9 | 60 | 5 | — | A | silica B | 10 | — | — | — | 1.2 | 130 |
| 10 | 60 | 5 | — | A | silica B | 15 | — | — | — | 1.2 | 130 |
| 11 | 60 | 5 | 0.4 | A | silica A | 10 | — | — | — | 1.2 | 130 |
| 12 | 60 | 5 | — | A | — | — | A | 0.5 | — | 1.2 | 130 |
| 13 | 60 | 5 | — | A | silica B | 10 | A | 0.5 | — | 1.2 | 130 |
| 14 | 60 | 5 | — | A | silica B | 10 | A | 0.5 | 10 | 1.2 | 130 |
| 15 | 60 | 5 | — | A | — | — | B | 0.5 | — | 1.2 | 130 |
| 16 | 60 | 5 | — | A | silica B | 10 | B | 0.5 | — | 1.2 | 130 |
| 17 | 40 | 5 | — | A | silica B | 10 | — | — | — | 1.2 | 130 |
| 18 | 60 | 5 | — | A | silica B | 10 | — | — | — | 0.7 | 130 |
| 19 | 60 | — | — | A | silica B | 10 | — | — | — | 0.7 | 130 |
| 20 | 150 | 5 | — | A | silica B | 10 | — | — | — | 1.2 | 130 |
| 21 | 60 | 5 | — | A | silica B | 10 | — | — | — | 3.0 | 130 |
| 22 | 60 | 5 | — | B | silica B | 10 | — | — | — | 1.2 | 130 |
| 23 | 60 | 5 | — | B | silica B | 10 | A | 0.5 | — | 1.2 | 130 |
| 24 | 60 | — | — | B | silica B | 10 | A | 0.5 | — | 0.7 | 130 |
| 25 | 60 | 5 | — | A | $SrCrO_4$ | 10 | — | — | — | 1.2 | 130 |
| 26* | 60 | 5 | — | A | silica B | 45** | — | — | — | 1.2 | 130 |
| 27* | 5** | 5 | — | A | silica B | 10 | — | — | — | 1.2 | 130 |

TABLE 4-continued

| Run No | Undercoat chromate layer: Cr weight (mg/ni as Cr) | $Fe_2P$[1] | $SrCrO_4$[1] | Organic topcoat layer: Base Resin[2] | Inorganic filler: Class[3] | Inorganic filler: vol %[4] | Cross-link. agent: Class[4] | Cross-link. agent: Amount[5] | Polybutyral plasticizer (weight %)[6] | Dry film thickness (μm) | Baking temp. (°C.) |
|---|---|---|---|---|---|---|---|---|---|---|---|
| 28* | 630** | 5 | — | A | silica B | 10 | — | — | — | 1.2 | 130 |

(Notes)
[1]Weight ratio relative to total chronic acid as $CrO_3$.
[2]Base Resin A: Polyhydroxypolyether resin in which the molar ratio of mononuclear/dinuclear phenol is 1/1 (a 1/1 mixture of resorcinol and bisphenol A) Base Resin B: Polyhydroxypolyether resin in which the dihydric phenol is bisphenol A (PKHH phenoxy resin).
[3]Silica A: colloidal silica with an average particle diameter of 10–20 nm (OSCAL 1432, Shokubai Kasei); Silica B: colloidal silica with an average particle diameter of 10–20 nm (OSCAL 1622, Shokubai Kasei);
[4]Cross-linking agent A: Blocked isocyanate-type epoxy curing agent (releasing temerature 80° C.); Cross-linking agent B: Blocked isocyanate-type epoxy curing agent (releasing temerature 145° C.);
[5]Ratio of the total number of the functional groups in the cross-linking agent to the total number of hydroxyl and epoxy functional groups in the resin.
[6]Percent based on the total resin solids in the coating composition.

TABLE 5

| Run No. | Corrosion resistance (% red rusted area): Flat sheet | Corrosion resistance: After drawing | Formability (% peeled-off area of coating) | Electrodeposition: Appearance | Electrodeposition: Secondary adhesion | Weldability | Dissolved Cr ($mg/m^2$): Degreasing solution | Dissolved Cr: Zn phosphate solution |
|---|---|---|---|---|---|---|---|---|
| 1 | 0 | 0 | 0 | ○ | ○ | ○ | 0 | 0.3 |
| 2 | 0 | 0 | 0 | ○ | ○ | ○ | 0 | 0 |
| 3 | 0 | 0 | 0 | ○ | ○ | ○ | 0.2 | 0.3 |
| 4 | 0 | 0–2 | 0 | ○ | ○ | ○ | 0.3 | 0.2 |
| 5 | 0 | 0 | 0 | ○ | ○ | ○ | 0 | 0 |
| 6 | 0 | 0 | 0 | ○ | ○ | ○ | 0.3 | 0.2 |
| 7 | 0 | 0 | 2 | ○ | ○ | ○ | 0.2 | 0.3 |
| 8 | 0 | 0 | 0 | ○ | ○ | ○ | 0.2 | 0 |
| 9 | 0 | 0 | 0 | ○ | ○ | ○ | 0.3 | 0 |
| 10 | 0 | 0 | 1 | ○ | ○ | ○ | 2.7 | 0 |
| 11 | 0 | 0 | 0 | ○ | ○ | ○ | 0.8 | 0.6 |
| 12 | 0 | 0 | 0 | ○ | ○ | ○ | 1.0 | 0.3 |
| 13 | 0 | 2 | 2 | ○ | ○ | ○ | 1.2 | 0.3 |
| 14 | 0 | 0 | 1 | ○ | ○ | ○ | 0.8 | 0.2 |
| 15 | 0 | 0 | 3 | ○ | ○ | ○ | 0.7 | 0.4 |
| 16 | 0 | 1 | 1 | ○ | ○ | ○ | 0.6 | 0.3 |
| 17 | 0 | 5 | 0 | ○ | ○ | ○ | 0.2 | 0 |
| 18 | 0 | 2 | 0 | ○ | ○ | ○ | 0.5 | 0.2 |
| 19 | 0 | 0 | 0 | ○ | ○ | ○ | 0.8 | 0.2 |
| 20 | 0 | 0 | 5 | ○ | ○ | Δ | 2.2 | 0.3 |
| 21 | 0 | 0 | 3 | X | — | X | 0 | 0 |
| 22 | 0 | 1 | 2 | ○ | ○ | ○ | 1.0 | 0.2 |
| 23 | 0 | 0 | 1 | ○ | ○ | ○ | 0.7 | 0.2 |
| 24 | 0 | 2 | 1 | ○ | ○ | ○ | 1.2 | 0.3 |
| 25 | 0 | 0 | 0 | ○ | ○ | ○ | 2.3 | 23 |
| 26* | 0 | 20 | 10 | Δ | ○ | X | 0.8 | 0.2 |
| 27* | 50 | 70 | 2 | ○ | ○ | ○ | 0 | 0 |
| 28* | 0 | 0 | 50 | ○ | ○ | X | 20 | 3 |

TABLE 6

| No. | Chromate Solution, Undercoat Chromate Layer: $SiO_2/CrO_3$ in Solution | Initial $Cr^{3+}$/Total Cr | Glycerin (g/l) | OH group/$Cr^{6+}$ in Glycerin | Coupling Agent (g/l) | Cr Deposition ($mg/m^2$) | Resin Solution, Top coat: Resin | $SiO_2$ (%) | Cross-linking Agent (Molar Ratio) | Butyral Resin | Thickness (μm) |
|---|---|---|---|---|---|---|---|---|---|---|---|
| 1 | 0 | 0.4 | 15 | 2 | 0 | 60 | A | 15 | 0.5 | — | 0.8 |
| 2 | 0 | 0.5 | 6 | 1 | 0 | 60 | A | 15 | 0.5 | — | 0.8 |
| 3 | 0 | 0.5 | 12 | 2 | 0 | 30 | A | 15 | 0.5 | — | 0.8 |
| 4 | 0 | 0.5 | 12 | 2 | 0 | 60 | A | 15 | 0.5 | — | 0.8 |
| 5 | 0 | 0.5 | 12 | 2 | 0 | 90 | A | 15 | 0.5 | — | 0.8 |
| 6 | 0 | 0.5 | 12 | 2 | 10 | 60 | A | 15 | 0.5 | — | 0.8 |
| 7 | 0 | 0.5 | 12 | 2 | 0 | 60 | A | 15 | 0.5 | — | 0.6 |
| 8 | 0 | 0.5 | 12 | 2 | 0 | 60 | A | 15 | 0.5 | — | 1.2 |
| 9 | 0 | 0.5 | 12 | 2 | 0 | 60 | A | 15 | 0 | — | 0.8 |
| 10 | 0 | 0.5 | 12 | 2 | 0 | 60 | A | 15 | 0.5 | 10 | 0.8 |
| 11 | 0 | 0.5 | 12 | 2 | 0 | 60 | B | 15 | 0.5 | — | 0.8 |
| 12 | 0 | 0.5 | 12 | 2 | 0 | 60 | C | 15 | 0.5 | — | 0.8 |
| 13 | 0 | 0.5 | 12 | 2 | 0 | 60 | A | 25 | 0.5 | — | 0.8 |
| 14 | 0 | 0.5 | 18 | 3 | 0 | 60 | A | 15 | 0.5 | — | 0.8 |
| 15 | 0 | 0.6 | 10 | 2 | 0 | 60 | A | 15 | 0.5 | — | 0.8 |
| 16 | 0.5* | 0.5 | 12 | 2 | 0 | 60 | A | 15 | 0.5 | — | 0.8 |
| 17 | 1.0* | 0.5 | 12 | 2 | 0 | 60 | A | 15 | 0.5 | — | 0.8 |
| 18 | 1.5* | 0.5 | 12 | 2 | 0 | 60 | A | 15 | 0.5 | — | 0.8 |
| 19 | 0 | 0.5 | 0 | 0* | 0 | 60 | A | 15 | 0.5 | — | 0.8 |
| 20 | 0 | 0.5 | 31 | 5* | 0 | 60 | A | 15 | 0.5 | — | 0.8 |
| 21 | 0 | 0.5 | 12 | 2 | 0 | 10* | A | 15 | 0.5 | — | 0.8 |
| 22 | 0 | 0.5 | 12 | 2 | 0 | 150* | A | 15 | 0.5 | — | 0.8 |

TABLE 6-continued

| | | | | | | | | | | | |
|---|---|---|---|---|---|---|---|---|---|---|---|
| 23 | 0 | 0.5 | 12 | 2 | 0 | 60 | A | 0* | 0.5 | — | 0.8 |
| 24 | 0 | 0.5 | 12 | 2 | 0 | 60 | A | 40* | 0.5 | — | 0.8 |
| 25 | 0 | 0.5 | 12 | 2 | 0 | 60 | A | 15 | 0.5 | — | 0.2* |
| 26 | 0 | 0.5 | 12 | 2 | 0 | 60 | A | 15 | 0.5 | — | 2.0* |

| | Weldability | | | Corrosion Resistance % Area of Blisters | | | Solved Cr (mg/m²) | |
|---|---|---|---|---|---|---|---|---|
| No. | Uniformness of Welding | Electrode Diameter After Welding | Overall Evaluation | Plate | Cup | Electro-deposition Appearance | During Degreasing | During Chemical Treatment |
| 1 | 0/100 | ○ | ○ | 0 | 0~1 | ○ | 0.7 | 0.5 |
| 2 | 0/100 | ○ | ○ | 0 | 0~1 | ○ | 0.8 | 0.4 |
| 3 | 0/100 | ○ | ○ | 0 | 3~5 | ○ | 0.3 | 0.2 |
| 4 | 0/100 | ○ | ○ | 0 | 0 | ○ | 0.4 | 0.4 |
| 5 | 0/100 | ○ | ○ | 0 | 0 | ○ | 0.8 | 0.7 |
| 6 | 0/100 | ○ | ○ | 0 | 0 | ○ | 0.2 | 0.1 |
| 7 | 0/100 | ○ | ○ | 0~1 | 4~5 | ○ | 0.9 | 0.5 |
| 8 | 1/100 | O~Δ | O~Δ | 0 | 0 | ○ | 0.3 | 0.1 |
| 9 | 0/100 | ○ | ○ | 0~1 | 3~4 | ○ | 0.6 | 0.2 |
| 10 | 0/100 | ○ | ○ | 0 | 0~1 | ○ | 0.4 | 0.6 |
| 11 | 0/100 | ○ | ○ | 0 | 0 | ○ | 0.5 | 0.5 |
| 12 | 0/100 | ○ | ○ | 0 | 1~2 | ○ | 0.4 | 0.7 |
| 13 | 1/100 | O~Δ | O~Δ | 0 | 0 | ○ | 0.6 | 0.7 |
| 14 | 0/100 | ○ | ○ | 0 | 0~2 | ○ | 0.2 | 0.1 |
| 15 | 0/100 | ○ | ○ | 0 | 0 | ○ | 0.1 | 0.3 |
| 16 | 7/100 | Δ | Δ | 0 | 0 | ○ | 0.4 | 0.1 |
| 17 | 16/100 | Δ | Δ | 0 | 0 | ○ | 0.5 | 0.3 |
| 18 | 22/100 | X | X | 0 | 1~3 | ○ | 0.2 | 0.2 |
| 19 | 0/100 | ○ | ○ | 8~10 | 75 | ○ | 14.3 | 12.1 |
| 20 | 2/100 | O~Δ | O~Δ | 10 | 83 | Δ | 0.1 | 0.1 |
| 21 | 1/100 | O~Δ | O~Δ | 20~25 | 97 | ○ | 0.1 | 0.1 |
| 22 | 11/100 | Δ | Δ | 0 | 0 | Δ | 1.1 | 0.8 |
| 23 | 0/100 | ○ | ○ | 2~4 | 5~8 | Δ | 0.3 | 0.2 |
| 24 | 9/100 | Δ | Δ | 0 | 0 | ○ | 1.3 | 0.9 |
| 25 | 0/100 | ○ | ○ | 12 | 90 | ○ | 2.5 | 1.9 |
| 26 | 19/100 | X | X | 0 | 0 | X | 0 | 0.1 |

COMPARATIVE EXAMPLE

This example was carried out so as to prove effectiveness of two stage-reduction of chromium, i.e., the presence of partially-reduced chromic acid in the chromate solution with respect to improvement in corrosion resistance.

As in the preceeding Examples 1 and 2, a steel sheet 0.8 mm thick was electroplated with a Zn-Ni alloy in an amount of 20 g/m². Prior to the chromate formation treatment, the steel sheet was subjected to degreasing with an alkaline cleaner (FC-L 4480, trade name of Nihon Parkerizing).

A chromate solution having the following basic composition was applied to the degreased one surface of the sheet.

| Basic Composition | $CrO_3$ | $H_3PO_4$ | $H_2SiF_6$ | $SiO_2$* |
|---|---|---|---|---|
| g/l | 50 | 12 | 2 | 50 |

Note: *Snowtex of Nissan Kagaku

After coating with the chromate solution, the steel sheet was dried at 120° C. A topcoating comprising urethane-modified high-molecular epoxy resin which contains phenol resin and colloidal silica in amounts of 16% and 15% respectively was applied and then hardened at 140° C.

The resulting coated steel sheet was dipped in a degreasing solution (20 g/l) at 60° C. for 15 minutes so as to determine the solve-out of chromium from the coated layyer. The resistance to corrosion was also determined in the same manner as in the preceeding examples.

The amount of Cr was determined using fluorescent X-ray analysis. The fixed Cr ratio was calculated by the following equation:

Fixed Cr Ratio = Cr content after dipping/Cr content before dipping

The test results are summarized in the following Table.

| Run No. | Chromate Formation Treatment Additive *1 | Additive *2 | Cr content | Topcoating (Thickness) | Fixed Cr ratio (%) | Corrosion Resistance Flat Sheet | After Drawing | Remarks |
|---|---|---|---|---|---|---|---|---|
| 1 | Ethylene glycol 6 g/l | None | 70 mg/m² | None | 40 | — | — | Pretest |
| 2 | Ethylene glycol 6 g/l | Glycerin 27 g/l | " | None | 61 | — | — | " |
| 3 | None | Glycerine 43 g/l | " | None | 59 | — | — | " |
| 4 | Ethylene glycol 6 g/l | None | " | 0.8 μm | 70 | 30 | 100 | Comparative |
| 5 | Ethylene glycol 6 g/l | Glycerin 27 g/l | " | " | 95 | 0 | 0 | Invention |
| 6 | None | Glycerin | " | " | 90 | 5 | 20 | Comparative |

-continued

| Run No. | Chromate Formation Treatment Additive *1 | Additive *2 | Cr content | Topcoating (Thickness) | Fixed Cr ratio (%) | Corrosion Resistance Flat Sheet | After Drawing | Remarks |
|---|---|---|---|---|---|---|---|---|
| | | | 43 g/l | | | | | |

Note
*1 Added one day before the application.
*2 Added one hour before the application.

As is apparent from the results shown in the Table above, when the topcoating is not provided, the fixed Cr ratio after degreasing is 60% even if the two-stage reduction is applied. On the other hand, when the topcoating is applied, as shown in No. 5, the fixed Cr ratio is very high, i.e., 95%.

In addition, Run Nos. 4 and 6 show the cases in which reduction was carried out at once, i.e., single-stage reduction was carried out, and Run No. 4 allows the presence of partially-reduced chromic acid. In these cases, however, the fixed Cr ratio is remarkably small in comparison with that in Run No. 5 which falls within the range of the present invention.

Thus, according to the present invention, the resistance to corrosion can be improved much more than the conventional chromate formation treatment. Compare Run Nos. 4 and 6 with Run No. 5. This is because two-stage reduction is caried out before application in the present invention.

As described and demonstrated above, the precoated steel sheets of the present invention can be successfully welded by resistance welding when the organic topcoat has a thickness of about 22.5 μm or less, and even with such a thin film thickness of the topcoat, they still maintain the properties of good corrosion resistance and formability. Therefore, they are particularly suitable for use in automobile bodies. The precoated steel sheets of the present invention are also useful in the manufacture of household appliances, business machines, and the like, and as building materials.

Although the invention has been described with respect to preferred embodiments, it is to be understood that variations and modifications may be employed without departing from the concept of the invention as defined in the following claims.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A precoated steel sheet having improved corrosion resistance and formability produced by (i) applying an undercoat of a chromate film with a weight of 10-600 mg/m$^2$ as Cr to the plated surface of a Zn- or Zn alloy plated steel sheet, wherein the undercoat comprises an aqueous suspension containing partially-reduced chromic acid, colloidal silica and at least one reducing agent selected from the group consisting of a polyhydric alcohol, a polycarboxylic acid, and a hydroxycarboxylic acid in amounts such that weight ratio of silica to total chromic acid is in the range of from 0.1:1 to 5:1, and is produced by (a) introducing an effective amount of the at least one reducing agent into the suspension under effective temperatures to provide a partially-reduced chromic acid which has a ratio of $Cr^{3+}/(Cr^{3+}+Cr^{6+})$ in range of from 0.1 to 0.6, and (b) introducing an additional amount of the at least one reducing agent such that the molar ratio of reducing agent to unreduced chromic acid is in the range of from 0.1:1 to 2.0:1;

(ii) applying a topcoat of 0.3 to 10 μm in thickness to the sheet which top coat is formed from a coating composition containing as a base resin a polyhydroxypolyether resin prepared by polycondensation of a dihydric phenol component selected from a mononuclear dihydric phenol, dinuclear dihydric phenol, and a mixture of both with an epihalohydrin, and (iii) baking said topcoat at a temperature of from 80° to 200° C., and further wherein both said undercoat and topcoat layers are free of a substantial amount of zinc powder.

2. A precoated steel sheet according to claim 1 wherein said partially reduced chromic acid has a ratio of $Cr^{3+}/(Cr^{3+}+Cr^{3+})$ in the range of from 0.3 to 0.6.

3. A precoated steel sheet according to claim 1 wherein said aqueous suspension further contains a silane coupling agent in an amount such that the molar ratio of silane coupling agent to unreduced chromic acid is at least 0.01:1.

4. A precoated steel sheet according to claim 1 wherein said aqueous suspension further contains an iron phosphide powder in an amount such that the weight ratio of iron phosphide to total chromic acid is in the range of from 0.1:1 to 20:1.

5. A precoated steel sheet according to claim 1 wherein said aqueous suspension further contains a metal chromate in an amount such that the molar ratio of metal chromate to unreduced chromic acid is at most 1:1, or a metal oxide or hydroxide as a precursor of a metal chromate in an amount such that the molar ratio of precursor to unreduced chromic acid is at most 0.5:1.

6. A precoated steel sheet according to claim 1 wherein said aqueous suspension further contains at least one additive selected from a silane coupling agent in an amount such that the molar ratio of silane coupling agent to unreduced chromic acid is at least 0.01:1; at least one reducing agent selected from the group consisting of a polyhydric alcohol, a polycarboxylic acid, and a hydroxycarboxylic acid in an amount such that the molar ratio of reducing agent to unreduced chromic acid is in the range of from 0.01:1 to 2.0:1; an iron phosphide powder in an amount such that the weight ratio of iron phosphide to total chromic acid is in the range of from 0.1:1 to 20:1; a metal chromate in an amount such that the molar ratio of metal chromate to unreduced chromic acid is at most 1:1; or a metal oxide or hydroxide as a precursor of a metal chromate in an amount such that the molar ratio of precursor to unreduced chromic acid is at most 0.5:1.

7. A precoated steel sheet according to claim 1 wherein said polyhydroxypolyether resin is a high molecular-weight polyhydroxypolyether resin having a number-average molecular weight of at least 5000.

8. A precoated steel sheet according to claim 7 wherein said high molecular-weight polyhydroxypolyether resin has been prepared from a dihydric phenol component comprised at least partly of a mononuclear dihydric phenol.

9. A precoated steel sheet according to claim 1 wherein said polyhydroxypolyether resin has been prepared by polycondensation of resorcinol, bisphenol A, or a mixture of both, with an epihalohydrin.

10. A precoated steel sheet according to claim 1 wherein said polyhydroxypolyether resin-based coating composition further contains at least one selected from an inorganic filler in an amount of at most 40% by volume based on the total resin solids in the coating composition, and a cross-linking agent in such an amount that the ratio of the total number of functional groups in the cross-linking agent to the total number of epoxy and hydroxyl groups in the polyhydroxypolyether resin is at most 2.0:1.

11. A precoated steel sheet according to claim 10 wherein said polyhydroxypolyether resin-based coating composition further contains at least one plasticizer selected from an acrylate or methacrylate ester in an amount of at most 20% by weight based on the* total resin solids in the coating composition, and a flexible resin in an amount of at most 50% by weight based on the total resin solids in the coating composition.

12. A precoated steel sheet according to claim 1 wherein said polyhydroxypolyether resin-based coating composition further contains at least one plasticizer selected from an acrylate or methacrylate ester in an amount of at most 20% by weight based on the total resin solids in the coating composition, and a flexible resin in an amount of at most 50% by weight based on the total resin solids in the coating composition.

13. A precoated steel sheet according to claim 1 wherein said steel sheet is bake hardenable and each of the undercoat and topcoat layers has been baked at a temperature below 200° C.

14. A precoated steel sheet having improved corrosion resistance and weldability produced by (i) applying or firing after application an undercoat of a chromate film with a weight of 20–100 mg/m$^2$ as Cr to the plated surface of a Zn or Zn alloy-plated steel sheet, said undercoat is an aqueous suspension containing partially reduced chromic acid which is produced by (a) introducing an effective amount of a reducing agent under effective temperatures to provide a chromic acid having a ratio of $Cr^{3+}/(Cr^{3+}+Cr^{6+})$ of 0.4–0.6 and (b) introducing an additional amount of a reducing agent so as to provide an amount of reducing agent which is 1–4 times larger than that required to reduce the remaining $Cr^{6+}$ to $Cr^{3+}$, further wherein the aqueous suspension is substantially free from colloidal materials, and (ii) applying or firing after application a topcoating of 0.3–1.6 μm in thickness and which comprises a resin-containing solution which contains as a base resin an epoxy resin together with colloidal silica in amounts of 10–25% by weight based on the total amount of resin solids and colloidal silica in the resin-containing solution.

15. A precoated steel sheet as set forth in claim 14 wherein said aqueous suspension further comprises a silane coupling agent in an amount such that the molar ratio of silane coupling agent to unreduced chromic acid ($Cr^{6+}$) is at least 0.01:1.

16. A precoated steel sheet as set forth in claim 14 wherein said resin-containing solution further comprises a cross-linking agent in an amount such that the molar ratio of the total number of functional groups in the cross-linking agent to the total number of epoxy and hydroxyl groups in said epoxy resin is 0.1–2.0:1.

17. A precoated steel sheet as set forth in claim 14 wherein said resin-containing solution further comprises at least one additional resin which is capable of improving properties of the topcoat and which is present in an amount of 50% by weight or less based on the total amount of the resin solids in the resin-containing solution.

* * * * *